US007754068B2

(12) United States Patent
Menegassi De Almeida et al.

(10) Patent No.: US 7,754,068 B2
(45) Date of Patent: Jul. 13, 2010

(54) PROCESS FOR THE SELECTIVE HYDRODESULFURIZATION OF NAPHTHA STREAMS

(75) Inventors: Rafael Menegassi De Almeida, Rio de Janeiro (BR); Jefferson Roberto Gomes, Rio de Janeiro (BR); Guilherme Luis Monteiro De Souza, Niteroi (BR); Joy Leslie, legal representative, Niteroi (BR); Xiaondong Hu, Louisville, KY (US)

(73) Assignee: Petroleo Brasileiro S.A.-Petrobras, Rio De Janerio (BR)

( * ) Notice: Subject to any disclaimer, the term of this patent is extended or adjusted under 35 U.S.C. 154(b) by 429 days.

(21) Appl. No.: 11/602,212

(22) Filed: Nov. 21, 2006

(65) Prior Publication Data

US 2007/0267326 A1 Nov. 22, 2007

(30) Foreign Application Priority Data

May 17, 2006 (BR) ..... 0601787

(51) Int. Cl.
*C10G 45/72* (2006.01)

(52) U.S. Cl. ..... 208/210; 208/216 R; 208/217

(58) Field of Classification Search ..... 208/210, 208/216 R, 217
See application file for complete search history.

(56) References Cited

U.S. PATENT DOCUMENTS

| | | | | |
|---|---|---|---|---|
| 2,061,845 | A | | 11/1936 | Morrell |
| 2,070,295 | A | | 2/1937 | Morrell |
| 2,273,297 | A | | 2/1942 | Szayna |
| 2,793,170 | A | | 5/1957 | Stiles et al |
| 3,349,027 | A | | 10/1967 | Carr et al. |
| 3,732,155 | A | | 5/1973 | Cecil et al. |
| 3,957,625 | A | | 5/1976 | Orkin |
| 4,132,632 | A | | 1/1979 | Yu et al. |
| 4,140,626 | A | | 2/1979 | Bertolacini et al. |
| 4,328,127 | A | * | 5/1982 | Angevine et al. ..... 502/219 |
| 4,334,982 | A | | 6/1982 | Jacquin et al. |
| 4,397,739 | A | | 8/1983 | Jacquin et al. |
| 5,340,466 | A | | 8/1994 | Dai et al. |
| 5,441,630 | A | | 8/1995 | Dai et al. |
| 5,459,118 | A | | 10/1995 | Dai et al. |

(Continued)

FOREIGN PATENT DOCUMENTS

| | | |
|---|---|---|
| BR | PI 0202413-6 | 6/2002 |

(Continued)

*Primary Examiner*—Walter D Griffin
*Assistant Examiner*—Renee Robinson
(74) *Attorney, Agent, or Firm*—Sughrue Mion, PLLC

(57) ABSTRACT

A process for the selective hydrodesulfurization of naphtha streams containing olefins and organosulfur compounds that minimizes olefin hydrogenation and results in a reduced sulfur content product. This is attained by two-stage hydrodesulfurization and $H_2S$ removal from the first stage effluent, with the first reaction stage catalyst being a more active HDS catalyst than the second reaction stage catalyst. Hydrogen and a non-reactive compound are fed to the first stage, with the $H_2$ mole fraction in the mixture of $H_2$ and non-reactive compound being from 0.2 to 1.0. $H_2S$ at the reactor inlet is limited to not more than 0.1% by volume. Hydrogen and a non-reactive compound are fed to the second reaction stage, the $H_2$ mole fraction in the mixture of $H_2$ and non-reactive compound being from 0.2 to 0.7. $H_2S$ at the reactor inlet is limited to not more than 0.05% by volume.

18 Claims, 7 Drawing Sheets

U.S. PATENT DOCUMENTS

| | | | |
|---|---|---|---|
| 5,851,382 | A | 12/1998 | Sudhakar |
| 5,853,570 | A | 12/1998 | Hatanaka et al. |
| 5,906,730 | A | 5/1999 | Hatanaka et al. |
| 6,126,814 | A | 10/2000 | Lapinski et al. |
| 6,231,753 | B1 | 5/2001 | McKnight et al. |
| 6,231,754 | B1 | 5/2001 | Brignac et al. |
| 6,429,170 | B1 | 8/2002 | Dodwell |
| 6,482,314 | B1 | 11/2002 | Khare |
| 6,692,635 | B2 | 2/2004 | Didillon et al. |
| 6,736,962 | B1 | 5/2004 | Cook et al. |
| 2003/0042175 | A1 | 3/2003 | Debuisschert et al. |
| 2003/0217951 | A1 | 11/2003 | Marchal-George et al. |
| 2003/0232723 | A1 | 12/2003 | Dodwell et al. |
| 2004/0000057 | A1 | 1/2004 | Graca |
| 2004/0000507 | A1 | 1/2004 | de Almeida et al. |
| 2004/0026298 | A1 | 2/2004 | Ellis et al. |
| 2006/0096893 | A1 | 5/2006 | de Almeida et al. |
| 2007/0114156 | A1 * | 5/2007 | Greeley et al. ..... 208/208 R |

FOREIGN PATENT DOCUMENTS

| | | |
|---|---|---|
| BR | PI 0502040-9 | 1/2007 |
| WO | WO 03/085068 A1 | 10/2003 |

* cited by examiner

PROCESS FOR THE SELECTIVE HYDRODESULFURIZATION OF NAPHTHA STREAMS

FIELD OF THE INVENTION

The present invention relates to a process for the selective hydrodesulfurization of naphtha streams containing olefins and organosulfur compounds, more specifically, the said process comprises two reaction steps where the feed contacts a hydrogen stream and at least one added non-reactive compound and the $H_2S$ effluent from the first reaction stage is withdrawn. For the first stage a more active HDS catalyst is used while for the second stage a less active HDS catalyst is used.

BACKGROUND OF THE INVENTION

In view of present environmental regulations, the gasoline specification for sulfur content is becoming limited to lower levels. The main source of sulfur in gasoline is catalytic cracked naphtha, which can contain typical values of 1,000 to 1,500 ppm wt. Besides the organosulfur compounds, the FCC naphtha includes typical olefin contents in the range of 25 to 35 mass %.

The conventional fixed bed hydrodesulfurization process (HDS) permits the attainment of low sulfur contents, but implies in the undesirable hydrogenation of olefins present in FCC naphtha, resulting in octane losses of the final gasoline pool containing FCC naphtha hydrodesulfurized stream.

Therefore there is a huge demand for the maintenance of the gasoline octane rating and hence, for processes aiming at reducing the sulfur content while maintaining the naphtha olefins. Several selective hydrodesulfurization technologies have been developed, where selectivity means the ability to remove sulfur with minimum olefin hydrogenation.

For example, an olefin-rich naphtha stream can initially be split into two distillation cuts, a heavy one and a light one, so that only the heavy cut undergoes a hydrodesulfurization reaction. By combining the two cuts after the reaction it is possible to keep the olefins of the light, more olefinic cut, so as to obtain a low-sulfur gasoline while preserving the octane rating.

U.S. Pat. Nos. 2,070,295, 3,957,625, and 4,397,739 describe such a process, however, a certain amount of sulfur remains in the light naphtha, so that the literature teaches processes including a further alkylation step of the thiophenic sulfur in the light naphtha so as to concentrate the sulfur in the heavy naphtha, such as described in U.S. Application 2003/0042175.

U.S. Pat. Nos. 3,957,625, 4,334,982, and 6,126,814 teach catalyst compositions where the catalyst features selectively favor the hydrodesulfurization function while reducing the olefin hydrogenation function.

Contrary to usual hydrorefining catalysts, HDS processes directed to olefinic naphtha streams employ Group VI B ($MoO_3$ being preferred) transition metal oxides and Group VIII (CoO being preferred) transition metal oxide catalysts in sulfided form during operation conditions, supported on suitable porous solids. Preferably the acidity of the supports is diminished with the aid of additives, or the acidity is intrinsically low. Also known are variations in metal contents and optimum ratios between them so as to favor the hydrodesulfurization while the hydrogenation of the olefin function is reduced.

For example, U.S. Pat. Nos. 4,132,632 and 4,140,626 describe the selective desulfurization of cracked naphtha streams using catalysts containing specified amounts of Group VI-B and Group VIII metals on a magnesia support containing at least 70% by weight of magnesium oxide and that can also contain additional refractory inorganic oxides such as alumina, silica or silica/alumina.

On the other hand, U.S. Pat. No. 5,441,630 makes use of catalysts of the same Group VI-B and Group VIII metals supported on a mixed basic oxide resulting from the mixture of hydrotalcite and alumina. The contents practiced in the mixture of hydrotalcite and alumina is from 1 mass % to 70 mass % hydrotalcite, preferably from 20 mass % to 60 mass % hydrotalcite.

U.S. Pat. Nos. 5,340,466 and 5,459,118, of the same Applicant as the above '630 patent teach a selective desulfurization process of cracked naphtha streams using a catalyst similar to that of U.S. '630, with additional deposition of Group I-A alkaline metal (such as $K_2O$).

U.S. Pat. No. 5,851,382 of the same Applicant teaches the use of the same metals of Group VI-B and Group VIII and added Group I-A, where the support comprises essentially hydrotalcite (above 80 mass %) and less than 20 mass % of a binder to allow extrusion. As binders are used silica, silica-alumina, titania, clays, carbon and their mixtures, but not alumina, this leading to higher selectivity towards sulfur removal with lower olefin hydrogenation as compared to catalysts of previous U.S. patents of the same Applicant containing alumina in the support composition.

Further patents directed to processes for the naphtha hydrodesulfurization claim the use of selective catalysts. U.S. Pat. No. 6,231,754 teaches the use of a catalyst rendered selective by the use of low metal contents, the catalyst having previously been deactivated through previous use in other hydrorefining applications.

U.S. Pat. No. 4,334,982 claims the use of non-acidic supports, such as aluminates of metals such as cobalt, nickel, barium, magnesium or calcium, preferably calcium aluminate, besides specific ratios of Group VI-B and Group VIII metals.

U.S. Pat. No. 6,126,814 employs catalysts having lower metal contents (from 1 to 10 mass % $MoO_3$ and from 0.1 to 5 mass % CoO), this hindering the stacking of $MoS_2$ crystallites in the sulfided catalyst so as to render the catalyst more selective.

U.S. Pat. No. 5,853,570 also teaches that the metal content should be lower or the same to that required for depositing a monolayer of the metals on the support, so as to hinder crystallite stacking that favor olefin hydrogenation.

U.S. Pat. No. 2,793,170 teaches that lower pressures favor lower olefin hydrogenation degree, while hydrodesulfurization reactions are not hindered at the same degree. This document cites further that, besides the organosulfur compounds conversion reactions, a recombination reaction of the $H_2S$ reaction product also occurs with the remaining olefins, yielding mercaptan-related products. Such reactions render difficult to obtain sufficiently low sulfur contents in the product without promoting at the same time significant olefin hydrogenation. High temperatures also hinder the recombination reaction of olefins with $H_2S$. Brazilian Application PI BR 0202413-6 (corresponding to US Application 2004/0000507) of the Applicant and herein entirely incorporated as reference, teaches the mixture of non-reactive compounds to hydrogen in order to promote he selective hydrodesulfurization reaction of a cracked olefin stream feed. The mixture promotes the dilution of hydrogen in the reaction and minimizes olefin hydrogenation without significantly reducing the organosulfur compound conversion, while aiding in the minimization of the recombination reaction by reducing the concentration of $H_2S$ generated in the reaction. There is also observed that a higher ratio of gas volume per feed volume means lower sulfur content in the product.

As regards the several non-reactive compounds, it is observed that the desired selectivity increase effect is observed not only for nitrogen, but also for the several diluent compounds and mixtures of same. It is also observed that reduced overall pressure does not lead to the same reaction selectivity as that obtained from non-reactive compounds, reducing olefin conversion but resulting also in the sulfur content increase of the product.

International publication WO 03/085068 teaches a selective hydrodesulfurization process in which a mixed feed of naphtha streams containing higher than 5 mass % olefins reacts under usual hydrodesulfurization conditions upon contact with a selective catalyst. The process aims at reducing more than 90% of the sulfur content and hydrogenating less than 60% of the feed olefins, the expected octane rating loss being higher for separately treated streams than that obtained from naphtha streams treated in admixture. The co-processing of a mixture of an olefinic naphtha stream with an effective amount, between 10% and 80 mass % of non-olefinic naphtha aims at a gain of at least 0.1 in the octane rating of the final product as compared to the separated processing of the two feeds. No other component, besides non-olefinic naphtha is considered for admixture with the olefinic naphtha. Since naphtha streams usually have similar distillation ranges, the non-olefinic naphtha will be integrated to the final gasoline pool, this limiting the application of the co-processing technique in this case.

U.S. Pat. Nos. 6,429,170 and 6,482,314 disclose a process for removing sulfur from catalytic cracking naphtha streams in a single reaction stage. The process uses a partially sulfided Ni- or Co-based regenerable reactive adsorbent on a ZnO support. The zinc oxide absorbs the $H_2S$ resulting from conversion of the organosulfurized compounds, preventing the recombination reaction, thereby resulting in process selectivity. U.S. Patent Application 2003/0232723 uses nitrogen in the adsorption process with a regenerable reactive adsorbent to boost selectivity, wherein the hydrogen molar fraction in the mixture ($H_2$+$N_2$) must be greater than 0.8.

In addition to the single-stage processes described above, and also in order to suppress the recombination reactions, hydrodesulfurization processes have been applied to more than one reaction stage, in which the $H_2S$ generated in the reaction is removed between the stages.

U.S. Pat. No. 2,061,845 discloses the use of more than one reaction stage with $H_2S$ removed between the stages in the hydrotreatment of cracked gasoline, leading to lesser hydrogenation of olefins and lower octane rating decrease in comparison to single-stage hydrotreatment process. U.S. Pat. No. 3,732,155 discloses the use of two stages with $H_2S$ removed between them and without the charge contacting hydrogen in the second reaction stage.

U.S. Pat. No. 3,349,027 discloses two-stage hydrotreatment of olefinic naphtha streams, with intermediate $H_2S$ removal and with a high space velocity (LHSV), making it possible to remove virtually all mercaptans. Results suggest that the mercaptan reaction rate is rather high, quickly achieving a balance between olefins present and $H_2S$ in the product.

U.S. Pat. No. 5,906,730 discloses a two-stage hydrodesulfurization process for cracked naphtha, with 60-90% of the sulfur in the charge of each stage removed, allowing for total removal of up to 99% of the sulfur in the original naphtha and with less conversion of olefins in comparison to just one reaction stage. $H_2S$ generated in each reaction step is removed before the subsequent stage, so as to hinder the formation of mercaptans resulting from the recombination of $H_2S$ with the remaining olefins. U.S. Pat. No. 5,906,730 claims the operation of the reaction stages at specific hydrogen partial pressure ranges, from 0.5 to 3.0 MPag in the first stage and 0.5 to 1.5 MPag in the second stage. The claimed hydrogen partial pressures conditions are reached for total pressure conditions and hydrogen flow rates typical for cracked naphtha HDS. This patent does not contemplate or suggest the addition of non-reactive compounds added to the reaction aiming at reducing olefin hydrogenation.

U.S. Pat. No. 6,231,753 discloses a two-stage hydrodesulfurization process, with more than 70% of the sulfur removed in the first stage and 80% of the remaining sulfur removed in the second stage, leading to a total removal of more than 95% of the sulfur so as to retain the olefins. Between the two reaction stages the generated $H_2S$ is removed. In order to obtain better selectivity (olefin preservation) as compared to previously disclosed two-stage processes, it can be seen that the temperature and LHSV in the second reactor are higher than those in the first: a temperature of 10° C. or higher, and LHSV at least 1.5 times higher.

U.S. Pat. No. 6,231,753 citing the state-of-the-art teaches that the hydrorefining units preferably recycle the non-consumed hydrogen and make up the consumed hydrogen. This patent also teaches that the composition of the hydrogen make-up streams are higher than 60% by volume, preferably higher than 80% by volume, the remaining components being inert materials such as $N_2$, methane and the like.

The so-called cited inert materials possibly present in the make-up hydrogen originate from $H_2$ preparation methods. The presence and concentration of the so-called inert materials depend on the presence or not and on the efficiency of the units designed for the purification of the obtained $H_2$. Typically hydrogen is produced in units such as steam reform, or as a by-product of naphtha catalytic reform. Previously to purification processes, the hydrogen stream from the catalytic reform contains methane and light hydrocarbons, while that from the natural gas steam reform can contain $N_2$, the presence of $N_2$ being possible in the natural gas reform feed itself, in amounts typically lower than 10% by volume. Processes usually employed in the purification of these streams are absorption, membrane separation and molecular sieve adsorption—PSA (Pressure Swing Adsorption), among others. So-called inert compounds are considered according to state-of-the-art concepts as undesired contaminants, high-purity make-up hydrogen being employed so as to avoid inert build up in the hydrorefining unit gas recycle.

U.S. Pat. No. 6,231,753 does not consider the addition of non-reactive compounds added as a mean of minimizing olefin hydrogenation, and teaches that the hydrogen make-up stream is preferably of high purity. The amount of inert compounds present in the reaction medium, in case make-up hydrogen contains inert compounds, will depend on recycle flow rate in the system, on hydrogen consumption, on make-up flow rate, on the balance in the separator vessels and on the presence or not of a further treatment of the recycle gas for $H_2S$ removal, which can also remove a portion of the inert compounds.

U.S. patent Application 2003/0217951 discloses two reaction stages with intermediate $H_2S$ removal. This process differs from those in the previously cited patents in that more than 90% of the sulfur is converted in the first stage and the reaction rate in the second stage is slower than that in the first stage. A slower reaction rate can be obtained at a temperature lower than that in the first stage.

U.S. Pat. No. 6,736,962 discloses a two-stage process for removing sulfur, with an intermediate $H_2S$ removal step between them. A previously hydrodesulfurized olefinic naphtha, containing less than 30 mg/kg of non-mercaptidic sulfur compounds, is processed while contacting a catalyst together with a purge gas, under two possible conditions. When the purge gas is hydrogen, the second-stage catalyst is an irreducible oxide (merely a support, with no hydrogenating activity). When the purge gas is a gas compound, such as He, $N_2$, Ar, $CH_4$, natural gas, light gas, and mixtures of the same containing no hydrogen, the second-stage catalyst is a metal oxide of Group VIIIB promoted by a metal oxide of the supported Group VIB (hydrorefining catalyst). The invention does not contemplate mixtures of a purge gas and hydrogen.

Typical conditions for each reaction stage in HDS processes are: pressures ranging from 0.5 to 4.0 MPag, preferably from 2.0 to 3.0 MPag; temperatures ranging from 200 to 400° C., preferably from 260 to 340° C.; space velocity (volume processed per hour per volume of catalyst), or LHSV, from 1 to 10 $h^{-1}$; rate of hydrogen volume per processed charge volume ranging from 35 to 720 $Nm^3/m^3$; and hydrogen purity normally higher than 80%, and preferably higher than 90%.

Literature also indicates that when $H_2S$ is removed between reaction stages, $H_2S$ concentration at the second stage intake should preferably be less than 0.05% by volume (500 ppmv), or more preferably, the $H_2S$ concentration in the gas produced by the second reactor should be less than 0.05% by volume so that it may be recycled back to the first reactor untreated.

Brazilian Application PI BR 0502040-9 of the Applicant and herein completely incorporated as reference teaches a selective hydrodesulfurization process of olefinic naphtha streams where the said process comprises two reaction stages where the feed contacts hydrogen and at least one non-reactive added compound. The generated $H_2S$ is removed so that the concentration of same at the reactor inlet does not favor the recombination to mercaptans. It could be observed that the use of added non-reactive compound in both stages resulted in higher selectivity than in state-of-the-art processes, where two reaction stages were practiced with non-reactive added compound. Unexpectedly, the use of a non-reactive compound only in the second stage resulted in still higher selectivity than in the two stages addition. However, this publication considers the use of the same catalyst in both reaction stages.

U.S. Pat. No. 6,692,635 teaches a two-stage selective hydrodesulfurization process for olefinic naphtha streams with distinct catalysts in each stage. The first stage catalyst contains Group VI-B (preferably Mo or W) and Group VIII (preferably Co or Ni) metals supported on alumina or silica-alumina or still other porous solids such as magnesia, silica or titanium oxide, as such or admixed with alumina or silica-alumina, aiming at hydrogenating thiophenic compounds to more easily desulfurizable compounds as well as removing a portion of the sulfur compounds. The second catalyst aims at decomposing the sulfur compounds and is selected among the group of Ni, Co, Fe, Mo or W, it being important to control the sulfiding degree of the catalyst. The sulfiding degree of alumina-supported Ni, as taught by U.S. Pat. No. 2,273,297 alters the reaction selectivity by more or less favoring hydrogenation to the disadvantage of desulfurization, it being possible to keep a significant desulfurization activity at a lower hydrogenation activity level.

The reactive adsorption patents, U.S. Pat. No. 6,429,170 and U.S. Pat. No. 6,482,314 cited above also make use of the nature of the nickel sulfiding degree for diminishing the hydrogenating activity.

U.S. patent Application US2004/0026298 also teaches a cracked naphtha hydrodesulfurization process in a multiple bed, where the metal content of the second bed catalyst is from 10 to 95% lower than the first bed catalyst. Both are Group VIII and Group VI-B catalysts, preferably supported on alumina, and can still have from 1.0 to 3.0 mass % of additives deposited as alkaline metals or alkaline metal oxides or phosphorus.

Multiple processes are also seen in the art, indicative of the importance and the difficulties inherent to selective processes for removing sulfur from olefinic naphtha streams.

Accordingly, there is still a need for a catalytic hydrodesulfurization process capable of reducing the sulfur content in FCC naphtha charges to the maximum, with minimum olefin hydrogenation. This objective is reached through the process comprising two reaction stages where the feed contacts a hydrogen stream and at least a non-reactive compound preferably added in the second reaction stage and is removed the $H_2S$ effluent from the first reaction stage, a more active HDS catalyst in a first reaction stage and a less active HDS catalyst in a final reaction stage being employed, such process being described and claimed in the present application.

SUMMARY OF THE INVENTION

Broadly, the present invention is directed to a selective hydrodesulfurization process of a naphtha stream containing organosulfur compounds and olefins, such process aiming at reducing the sulfur content of said stream while at the same time minimizing olefin hydrogenation in said naphtha feed.

The process comprises a catalytic, two-stage hydrodesulfurization process through the contact of the naphtha feed with a hydrogen stream and added non-reactive compounds, with removal of the $H_2S$ effluent from the first reaction stage.

Thus, the selective hydrodesulfurization process of a naphtha stream containing organosulfur compounds and olefins according to the invention comprises the steps of:

a) contacting said naphtha feed containing from 20 to 50 mass % olefins and from 200 to 7,000 mg/kg sulfur in a first reaction stage, under hydrodesulfurization conditions comprising temperature in the range of 200 to 420° C., preferably 240-380° C., still more preferably in the range of 260-320° C., pressure in the range of 0.5 to 5.0 MPag, preferably 1.0 to 3.0 MPag, and liquid hourly space velocity (LHSV) from 1 to 20 $h^{-1}$, preferably 2 to 5 $h^{-1}$ in a reactor charged with a hydrorefining catalyst in sulfided form, with a hydrogen stream and at least one added non-reactive compound, while the amount of $H_2S$ at the reactor inlet is limited to not more than 0.1% by volume, to yield an effluent;

b) removing $H_2S$ from the effluent of the first reaction stage and obtaining a partially desulfurized naphtha; and c) Directing the naphtha obtained in step b) towards a second reaction stage, in a reactor charged with a hydrorefining catalyst in sulfided form, under hydrodesulfurization conditions similar to those of the said first reaction stage, and contacting said partially desulfurized naphtha with a stream which is a mixture of $H_2$ and at least one added non-reactive compound, while the amount of $H_2S$ at the reactor inlet is limited to not more than 0.05% by volume, said process comprising (i) in the first reaction stage, the hydrorefining catalyst is a catalyst which is more active for HDS while the $H_2$ fraction in the mixture of $H_2$ and at least one added non-reactive compound is the same or higher than said $H_2$ fraction added in the said second reaction stage;

(ii) in the second reaction stage, the hydrorefining catalyst is a catalyst which is less active for HDS and different from the said first stage catalyst, while the $H_2$ fraction in the mixture of $H_2$ and at least one added non-reactive compound is the same or lower than said $H_2$ fraction added in the said second reaction stage; and where (iii)the first stage catalyst is said more active for HDS than the second stage catalyst because said first stage catalyst requires, in order to obtain the same sulfur conversion and same hydrorefining conditions, lower temperature than the second stage catalyst to obtain the same sulfur content to process the same naphtha feed, whereby, the selectivity of the hydrodesulfurized naphtha recovered at the end of the said process is improved as compared to the selectivity of state-of-the-art processes.

Thus, the invention provides a hydrodesulfurization process that preserves the olefins and leads to hydrodesulfurized olefinic naphtha streams, advantageously, through the use of at least one added non-reactive compound in admixture with the hydrogen in distinct catalysts and optimized two-stage, hydrodesulfurization reaction conditions.

The invention still provides a hydrodesulfurization process of olefinic naphtha streams where the distinct catalysts involve a more active HDS catalyst in the first reaction stage and a less active HDS catalyst in the second reaction stage.

DETAILED DESCRIPTION OF THE INVENTION

Figure 1:
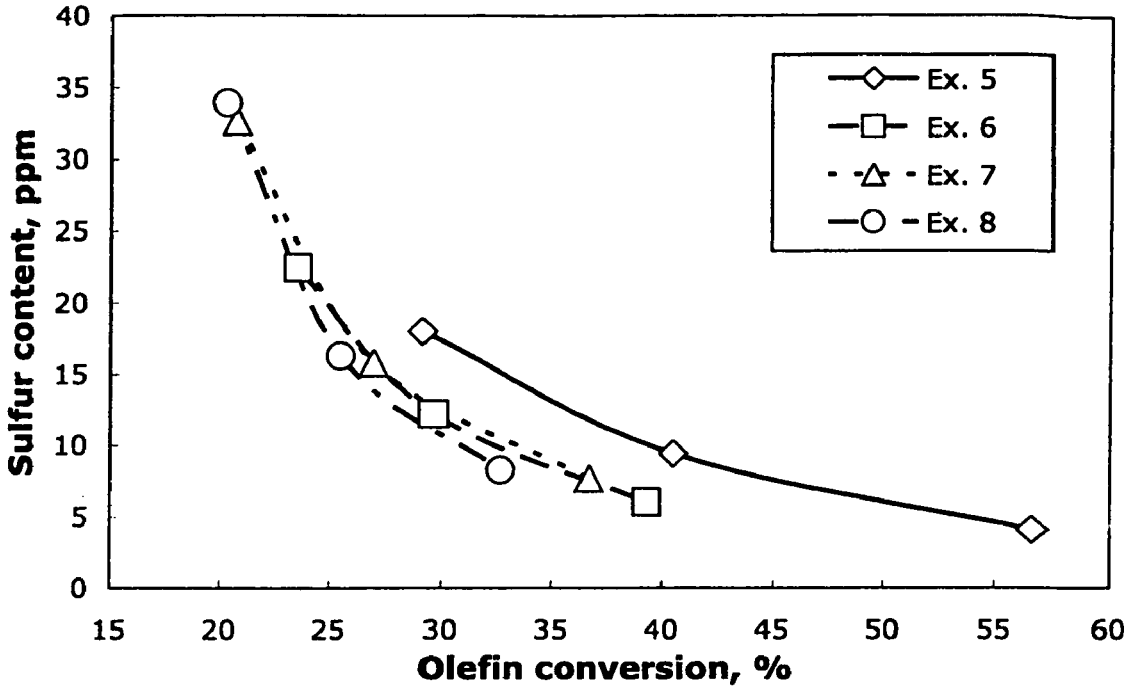
FIG. 1 attached is a graph that illustrates the effect in the second hydrodesulfurization stage, of the catalyst nature and of the presence of nitrogen on the hydrodesulfurization and olefin hydrogenation of a naphtha feed which has been previously desulfurized in a first reaction stage on a more active HDS catalyst in the presence of a hydrogen stream (described below in Example 1), with $H_2S$ removal between two stages, according to Examples 5 to 8.

The present invention relates to a catalytic hydrodesulfurization process in two reaction stages of a naphtha feed containing olefins and organosulfur compounds with a stream made up of a mixture of hydrogen and at least one added non-reactive compound. $H_2S$ is removed from the first stage effluent and hydrodesulfurized olefinic naphtha is recovered the sulfur content of which is reduced in more than 90 mass % while at most 40 mass % of the feed olefins is hydrogenated.

According to the invention, a reaction stage means a catalyst bed or set of catalyst beds or a reactor or set of reactors upstream or downstream the removal step of the $H_2S$ generated in the reaction.

Throughout the present specification and claims, the expressions "more active catalyst" or "more active HDS catalyst" and "less active catalyst" or "less active HDS catalyst" mean that, under the same reaction conditions and same feed, a more active HDS catalyst provides higher sulfur conversion than the less active HDS catalyst.

Further, the expressions "more active" and "less active" always refer to the hydrodesulfurization (HDS) activity. A typical more active HDS catalyst is a catalyst based on Group VIII metal oxides with Group VI metal oxides, sulfides under the reaction conditions, preferably supported on alumina or a similar porous solid, such as alumina-supported CoMo or NiMo, while the typical less active HDS catalyst is a catalyst of the same above-cited metals supported on a porous solid preferably basic or of reduced acidity, such as a mixed basic oxide, such as the MgO and alumina mixed oxide or still, on the oxide are supported Group I alkaline metals compounds and/or Group II alkaline earth metals. The "more active HDS catalyst" provides higher hydrodesulfurization than "the less active HDS catalyst".

This is equivalent to say that, for the same feed and same sulfur removal, while LHSV, gas/feed and pressure ratio are kept as such, the more active catalyst requires lower temperature than the less active one.

Different metal contents in the catalyst, different supports and catalyst textural properties can be employed without altering the scope of the present invention provided the said first reaction stage catalyst is more active than the said catalyst of the second reaction stage.

Still according to the invention, the expression "selectivity" means to reach desired sulfur contents of the product at the lowest possible olefin hydrogenation.

Useful feeds for the process of the invention are olefinic naphtha streams containing organosulfur compounds including, but not being limited to: catalytic cracking naphtha streams, fractionated catalytic naphtha streams, the light or heavy fractions thereof, narrow cuts, naphtha streams and their previously hydrogenated fractions for the removal of dienes and delayed coking naphtha streams, among others.

Typical feeds for the process of the present invention include olefinic naphtha streams having olefin content ranging from 20% to 50 mass % and sulfur content ranging from 200 to 7,000 mg/kg. Olefin content of naphtha streams obtained from catalytic cracking units frequently is from 25% to 35 mass % while sulfur content is from 1,000 to 1,500 mg/kg.

In practical terms, lower-than 300 ppm contents, preferably lower-than 200 ppm sulfur in the feed can be removed to fairly low levels in just one reaction stage. Naphtha streams of less than 200 ppm sulfur are usually obtained when some sulfur removal is carried out on the FCC feed (for example, gasoil hydrotreatment).

Olefinic naphtha streams can also contain dienes that are undesirable to the process when present in contents higher than 1.0 g $I_2$/100 g. In this case, the feed should be submitted to a selective hydrogenation process under low severity conditions in order to hydrogenate the dienes only so as to avoid coke build-up in heat exchangers and furnaces upstream the first stage hydrodesulfurization reactor, or on top of the reactor.

The present invention comprises a two-stage reaction, under usual hydrodesulfurization process conditions and usual or lesser volumetric ratios relative to the feed. To the hydrogen is admixed at least one added non-reactive compound so as to make up a stream which is admitted to the reactor at a temperature which is preferably higher than the dew point of the admixture.

Useful for the process of the present invention are non-reactive compounds selected among nitrogen, noble gases or saturated hydrocarbons (from $C_1$ to $C_4$), alone or admixed in any amount.

For the purposes of the invention, the composition of the added non-reactive compounds should include at least 90% by volume of non-reactive compounds under the process hydrodesulfurization conditions.

Still, the sulfur content of the said added non-reactive compounds is lower than 500 ppm and the olefin content is lower than 10 mass %.

For each stage of the hydrodesulfurization reaction are employed usual hydrorefining catalysts. For the purposes of the present invention, hydrorefining catalysts are those made up of Group VI B and Group VIII metal oxides supported on an appropriate porous solid. Preferred are sulfided catalysts made up of a mixture of metal oxides of Group VIII with Group VIB metals that, previously to sulfiding, contain Ni or Co and Mo or W oxides. The catalysts containing CoO and $MoO_3$ oxides provide better desulfurizing ability than the NiO and $MoO_3$ oxides, resulting in less olefin hydrogenation for the same hydrodesulfurization degree. The oxides are supported on a proper porous solid.

Non-limiting examples of the porous solids are alumina, silica, silica-alumina, zeolites, titania, carbon, aluminum phosphate, zinc oxide, diverse aluminates and diatomaceous earth.

Preferably the oxides are supported on alumina or on low acidity supports. The catalyst support can have the intrinsic acidity reduced either by using mixed oxides as support, such as $Al_2O_3$ and MgO, or by deposition of Group I alkaline metal compounds and/or Group II alkaline-earth metals.

Besides the MgO basic oxide as such or in admixture with $Al_2O_3$, basic oxides can be employed, as such or in admixture with alumina, such as: CaO, BeO, BaO, SrO, $La_2O_3$, $CeO_2$, $Pr_2O_3$, $Nd_2O_3$, $SmO_2$, $K_2O$, $Cs_2O$, $Rb_2O$, $ZrO_2$.

A mixture of several hydrorefining catalysts can still be considered in the hydrodesulfurizing reactors as well as the use of spent catalysts that have been deactivated by previous use in a different hydrorefining unit.

The Group VIB and Group VIII metal content as oxides in the catalyst support is generally in the range of 5 to 30 mass %.

The catalysts selected among those described in the present invention are used in the first or second reaction stages. Each reaction stage preferably contains a distinct hydrorefining catalyst.

Another option of the present invention refers to the use of more than one catalyst in each reaction stage. In this case, the activity resulting from the mixture or sequence of catalysts in the first reaction stage should be higher than in the second reaction stage. Thus the HDS activity of the reactor containing the said sequence or mixture of catalysts equivalent to the reactor or set of reactors of the first stage should be higher than the HDS activity of the reactor containing the said sequence or mixture of catalysts equivalent to the second reaction stage. Thus, sulfur removal by the combination of catalysts in the first reaction stage should be higher than the sulfur conversion by the combination of the second reaction stage, the feed being the same FCC naphtha under the same operation conditions.

The first and second reaction stage catalysts are of distinct activity. By distinct activity is meant that, at same test conditions and for the same feed, a catalyst provides higher sulfur compound conversion than another one, the lower HDS activity catalyst. The lower activity of one catalyst relative to another one means that the reaction temperature should be higher for a same sulfur removal level, being kept LHSV level, pressure, $H_2$/feed and gas/feed ratio. Preferably, the catalysts are made up of sulfided CoMo supported on suitable distinct porous solids.

Several catalyst arrangements having higher and lower activity in the first and second reaction stages can be employed in the present invention.

It is well-known that lower metal content in a catalyst reduces its activity for hydrogenation and HDS. It is further known that the support also influences the catalyst activity, with lower acidity or lower surface area supports reducing the HDS activity. The diminished activity means higher temperature reaction required for same HDS level. Thus, conditions predicted in the present invention include but are not limited to, the configurations described below to obtain a catalyst of higher HDS activity in the first reaction stage as compared to the second reaction stage catalyst.

The first reaction stage catalyst can have a higher metal content than the second reaction stage catalyst. Still, the catalyst in both reaction stages can have similar compositions but have distinct activity due to previous deactivation (such as for example spent catalyst and fresh catalyst). The first reaction stage catalyst can have a more acidic support (as for example, alumina) than the second reaction stage catalyst support (as for example the porous solids of $Al_2O_3$ and MgO mixed oxides). Different acidity levels in the catalyst of the first and second reaction stages can be consequent to the addition of additives on the support or the catalyst, such as Group I alkaline metal oxides and/or Group II alkaline earth metal oxides.

Different activities can also be consequent to the nature of the alumina used as support; various transition alumina phases having other than $\gamma$-$Al_2O_3$ phases, such as $\delta$- or $\theta$-$Al_2O_3$, these phases resulting from the heating of alumina hydrates.

Other aluminates can also be used. One of the catalysts can also have been previously treated using state-of-the-art methods to favor the coking and thus reducing the activity of the said catalyst.

It is thus apparent to the experts that various combinations among the different ways of obtaining catalysts of distinct activity can be employed in the present invention provided that the first reaction stage catalyst is more HDS active than that of the second reaction stage, or, in an equivalent way, that the second reaction stage catalyst is less HDS active than that of the first reaction stage.

Thus, the following are possible, however not limited to, the use of the same support with lower metal content in the second reaction stage catalyst, use of different supports, the second catalyst having a more basic support and same metal content in both reaction stages, the different activity to be obtained resulting from the addition of agents for reducing the acidity of the support only, or either a higher amount in the second stage only (such as Group I and/or Group II compounds), or the use of spent catalyst only in the second reaction stage, among other well-known means.

Further possibilities are the combination of one or more known means for reducing or increasing activity so as to obtain two distinct catalysts, the more active being utilized in the first reaction stage and the less active being utilized in the second reaction stage. The cited combination for reducing or increasing activity results, for example, in that the first catalyst being a silica-containing, alumina-supported hydrorefining CoMo catalyst and the second one, a CoMo catalyst of lower metal content supported on a magnesia and alumina mixed oxide, optionally with the addition of Group II alkaline earth metal in the catalyst.

Methods for reducing support acidity or a support other than alumina can also be employed in the first reaction stage catalyst, provided the second stage catalyst is less HDS active than the first reaction stage catalyst.

In one mode of the invention, each reaction stage comprises one or more hydrorefining catalysts, and each one can comprise one or more reaction sections.

In another mode of the invention, there is injection of $H_2$ or of a mixture of $H_2$ and added non-reactive compound, or of only the added non-reactive compound between reaction stages. Besides the addition of the gaseous stream, a portion of the feed or of the products can be added between the reaction stages. Addition of streams between the reaction stages aims at reducing the reaction temperature before the mixture reaches the next reaction section. It is well-known that the hydrogenation reaction is exothermic. If the product temperature is not controlled, olefin hydrogenation can be excessive, and hot spots can be formed in the reactor.

Preferably, the presence of at least one non-reactive compound inhibits olefin hydrogenation and accommodates the heat generated in the reaction, so as to limit the temperature increase. In the ideal condition of the present invention, there is no need to inject any stream to remove heat between the reactor sections.

Usual hydrodesulfurization reaction conditions are temperature in the range of 200 to 420° C., pressure in the range of 0.5 to 5.0 MPag and space velocity LHSV from 1 to 20 $h^{-1}$.

High temperatures increase hydrodesulfurization efficiency in that the recombination reaction of $H_2S$ and the remaining olefins is hindered, with very high temperatures (>420° C.) leading to accelerated catalyst deactivation. In the present invention the average temperature range desired in the reaction medium is from 200 to 420° C., preferably from 240 to 380° C., and more preferably from 260 to 320° C.

The heat released in the olefin hydrogenation reaction, an undesirable reaction in this process, causes an increase in the reactor temperature. More than one catalyst bed can be required depending on the released amount of heat, as well as hydrogen injection or injection of hydrogen and non-reactive compounds stream at lower temperature between two beds, so as to reduce the temperature before the subsequent bed. If two beds are required, these can also be separated into more than one reactor.

Preferably, the process conditions are optimized so as to obtain low olefin hydrogenation degree and, consequently, low heat release. This result is advantageously obtained by the presence of added non-reactive compounds that inhibit olefin hydrogenation and further provide better accommodation ability of the reaction medium generated heat.

As regards pressure, the higher the pressure the higher will be olefin hydrogenation, which renders the process less selective. However, fairly low pressures, lower than 1.0 MPag lead to reduced conversion of the organosulfur compounds, even if the said stream of non-reactive compounds and hydrogen added to naphtha contains pure $H_2$ (low or no non-reactive compound). In this way, the pressure in the hydrodesulfurization reactors is more preferably selected in the range of 1.0 to 3.0 MPag or still more preferably from 1.5 to 2.5 MPag.

The combined addition of non-reactive compounds with the two-stage HDS and $H_2S$ removal can be carried out according to various arrangements. Thus, the addition of non-reactive compounds can be carried out in both stages, in the first stage only or in the final (second) reaction stage.

It could be expected that the mere addition of non-reactive compounds in one or both stages of the state-of-the-art two-stage naphtha HDS process would result in selectivity gains. However, the Examples below illustrate that the addition of inert or non-reactive compounds in the initial stage only would lead to the same or lower selectivity levels as compared to those of state-of-the-art processes, without any advantage or gain. Still, specific combinations of various activity catalysts and addition of non-reactive compound in two reaction stages lead to selectivity gains superior to those reported in the literature. The addition of non-reactive compounds in both reaction stages or in the second stage only, with a more HDS active catalyst in the first stage, and lower HDS activity catalyst in the second reaction stage, provide important gains relative to the previous state-of-the-art.

It is well-known that the use of a lower activity state-of-the-art catalyst such as the one supported on a basic porous oxide results in selectivity gains when applied to a one-stage reaction process. Thus, it is expected that the use of the lower activity selective catalyst, in both reaction stages results in additional selectivity gain. However, the Examples show that the use of lower acidity catalysts in the first reaction stage only result in lower selectivity.

Still, it was surprisingly found that the addition of non-reactive compounds in the second stage only, with a higher activity catalyst in the first reaction stage, and a lower activity catalyst, such as the one supported on a porous basic oxide in the second stage, provided a gain relative to the addition of non-reactive compounds in both stages.

Without willing to limit the scope of the present invention, it is possible to explain the selectivity gains for HDS.

The limitation of the $H_2S$ content at the inlet of each reaction stage and, consequently at the outlet, restricts the $H_2S$ recombination reaction with the remaining olefins, so as to reduce the sulfur content of the end product.

The selectivity gain is reached through: (i) reduction of $H_2S$ content at the inlet of each reactor or reaction stage, this being reached by removing $H_2S$ in the hydrogen stream and at least one added non-reactive compound contacted with the olefin feed; and (ii) separation from one reaction stage to two reaction stages, plus removal of intermediate $H_2S$.

The maximum reduction of the undesirable recombination reaction could be attained by employing more reaction stages and removing the generated $H_2S$ before the following stage. The use of more than two reaction stages is, however, less practical from the industrial point of view. At the end of each reaction stage there is always a $H_2S$ content resulting from the conversion of the feed sulfur compounds, and, therefore, recombination.

It is believed that another way of reducing the recombination reaction besides the reduction of the $H_2S$ content at the inlet of each stage is to reduce the $H_2S$ concentration through alternative means.

Possible means for that purpose include the reduction of total pressure and the increase of the $H_2$/feed ratio. The reduced pressure would lead to lower $H_2S$ concentration. However, the conversion of thiophenic sulfur would also diminish (through reduction of the sulfur compound and hydrogen concentration and of the residence time in the reactor), reducing the overall sulfur removal.

The mere increase in the $H_2$/feed ratio tends to lead to lower sulfur content in the product, but, by increasing hydrogen concentration, olefin hydrogenation is also importantly increased.

On the other hand, the present invention, based on the removal of a great deal of the $H_2S$ formed by the separation of the reaction into two stages, plus the addition of non-reactive compound as a replacement to $H_2$, makes possible to reduce the $H_2S$ concentration while at the same time hinders olefin hydrogenation by reducing $H_2$ concentration.

The presence of a higher activity catalyst in the first reaction stage makes possible to obtain sufficient sulfur removal at low olefin conversion, with or without the presence of added non-reactive compound. Sufficient sulfur removal in the first reaction stage means obtaining sulfur contents such that, after $H_2S$ removal, the contents of recombinant sulfur in the first and final reaction stages are not significant for the desired sulfur conversion objectives (lower than 100 ppm sulfur). In practical terms, sufficient sulfur contents of the first reaction stage are of the order of 200 ppm, preferably 150, more preferably lower than 150 ppm. Examples 1 to 4 illustrate that the higher activity catalyst allowed, at same HDS level than the lower activity catalyst, to obtain sulfur compounds distinct from those present in the feed, with thiophenic compounds being converted to mercaptidic sulfur or hydrogenated species.

Thus, illustrative Examples set forth below make possible to ascertain the HDS selectivity increase after addition of non-reactive compound to both reaction stages.

Still, from the Examples below it is possible to observe the selectivity improvement using the combination between two reaction stages, different catalysts in each reaction stage and non-reactive compounds addition.

The Examples below-show that the solution of the present invention, that separates the reaction in two stages, utilizes different catalysts in each stage, reduces $H_2S$ concentration at the inlet of each stage and uses the injection of non-reactive compound in both stages or in the final (second) stage only allows higher selectivity levels than those obtained in state-of-the-art processes. By state-of-the-art is meant two-stage HDS with pure $H_2$ and at least one added non-reactive compound in one or both reaction stages and same catalysts in both reaction stages.

In case of the addition of non-reactive compound to both reaction stages, it is possible to operate with similar compositions of $H_2$+ non-reactive compounds in both reaction stages, or with various compositions, preferably with higher $H_2$/($H_2$+ non-reactive compound) molar ratio in the first reaction stage than in the second reaction stage.

Based on the illustrative Examples, it is reasonable to assume that higher selectivity with higher activity will be experienced in the first reaction stage so that thiophenic sulfur species will be converted, lower activity being observed in the final reaction stage.

Means of the present invention for reaching this objective include using higher activity catalyst in the first reaction stage, lower activity catalyst in the second reaction stage, and higher $H_2$ fraction in the mixture of $H_2$ and at least one added non-reactive compound in the first reaction stage than in the second reaction stage. The more advantageous selectivity condition will be observed for lower $H_2$ fraction in the mixture of $H_2$ and at least one added non-reactive compound fed to the second reaction stage, in less active catalyst. Or still, adding at least one non-reactive compound to the final reaction stage only.

Typical ranges include, for the first reaction stage, the $H_2$/($H_2$+ non-reactive compound) mole ratio between 0.2 and 1.0 and between 0.2 and 0.7 for the second reaction stage. A preferred range is 1.0 for the first reaction stage (hydrogen without the addition of non-reactive compound) and between 0.3 and 0.6 for the second reaction stage.

It is worthwhile to observe that the state-of-the-art technology considers the addition of non-reactive compounds, without hydrogen, to a second treating stage, similar to the second reaction stage described herein. However, the portion of thiophenic compounds that did not reacted in the first reaction stage will not be converted, it not being possible to reach the low desired sulfur contents obtained according to the present invention, as set forth in the Examples below.

Several process arrangements can be useful for the industrial execution of the invention. The usual configuration of hydrorefining units involves the recycling of non-reactive hydrogen following a high pressure separator. To the hydrogen recycle is added make-up hydrogen, to keep the pressure of the unit at the desired level, making up the hydrogen consumed in the reactions and lost in the steps of $H_2S$ removal and dissolved in the liquid product (in the gas and liquid separators).

For two reaction stages several arrangements are known, involving independent recycle gas operations at each stage or just one recycle, where the outlet gas of one reaction stage is fed to another reaction stage.

In case of independent recycle operations at each reaction stage, the outlet gas of each stage is recycled, plus the make-up hydrogen, towards the inlet of said reaction stage. According to the $H_2S$ and sulfur contents of each reaction stage feed, $H_2S$ removal can be performed in several ways. In case of one single recycle, and in case the sulfur content of the second stage feed is small, the $H_2S$ of the second stage output gas can be at a low level that does not cause any recombination problem, and thus it is directed straight to the first reaction stage. Since in the first reaction stage sulfur content is higher, it will be required to remove $H_2S$ from the gas and liquid product to be directed to the second reaction stage.

Further possible modifications envisaged by the experts include in case of independent recycle gas operations, just one or two units for sulfur removal from the gas. In the case of independent recycle gas operations, with a small sulfur content in the second stage feed, the $H_2S$ reached in the recycle can be small and does not cause any recombination problem, with only one $H_2S$ removal step being required (in the first stage recycle gas).

Similar arrangements can be evident for the experts in order to promote the two-stage reactions in the presence of at least one added non-reactive compound, under the conditions claimed in the present invention. Besides the injection of make-up $H_2$, the injection of make-up non-reactive compounds lost by solubility in the products or in the sulfur removal steps is also required.

In case of injection of $H_2$ and at least one added non-reactive compound streams, the control for the maintenance of the desired conditions is obtained by maintenance of the unit pressure and maintenance of the desired $H_2$ fraction in the mixture of $H_2$ and at least one added non-reactive compound.

Besides the $H_2$ injection and at least one non-reactive compound added separately, it is possible to add both compounds in a same stream or at least part of the non-reactive compound together with hydrogen.

Thus, some processes for producing $H_2$ lead one to obtain, for example, $H_2$ contaminated with compounds so-called inert such as $N_2$ or methane or ethane. However, the solubility losses of $H_2$ and of those compounds are distinct, and it would not be possible to control under arbitrary conditions the recycle compositions, those being a function of the $H_2$ consumption extent and of non-reactive or inert compound loss. Such practice is undesirable, since the complete means for maintenance of the operating conditions under the desired conditions are not provided.

In case of similar compositions of the mixture of $H_2$ and at least one non-reactive compound added in one reaction stage, the first stage output gas, in case the non-reactive compounds are not condensable, after $H_2S$ removal from the effluent, can be fed to the second unit and on its turn, the gas can be recycled to the first reaction stage. In case the sulfur content of the second stage feed is low, the sulfur content of the output gas of the second reaction stage should not necessarily attend to the upper $H_2S$ content limit at the beginning of the first reaction stage, 0.1 volume %.

Analogously, the $H_2S$ removal step from the first stage output gas should be efficient to the point that at the inlet of the second reaction stage the $H_2S$ content is lower than 0.05 volume %. The make-up of added non-reactive compounds and hydrogen can be performed in just one reaction stage, or in both, or separately in one or other reaction stage, reflecting on the operating conditions in each stage, resulting in small variations in the recycle stream composition in each process step, such variations being easily determined by the experts.

In case of different compositions of the mixture of $H_2$ and at least one non-reactive compound added in each reaction stage, including the situation of pure hydrogen in one of the stages, the gas recycle operations should be independent. The $H_2S$ removal step is required in the effluents from the first reaction stage, and can be required or not in the effluents of the second reaction stage, depending chiefly from the sulfur content of the second stage feed, so as to attend to the claimed criterion of maximum $H_2S$ content in the reaction stage.

Further process arrangements for attending the various modes of the present invention are possible and apparent to the experts, and as such do not contain any inventive step. Thus, means known in the art of fluid transport, product separation, $H_2S$ removal, make-up of reacted $H_2$ and lost compounds can be utilized for obtaining the conditions required for the several modes of the present invention.

Added non-reactive compounds, in case these are in the vapor state under condensation conditions past the reactor, are preferably slightly soluble in the product, remaining with hydrogen in the gas recycle, and preferably passing through an absorption tower for absorption of the $H_2S$ formed during the HDS reactions. The hydrogen consumed as well as the non-reactive gas lost through solubilization in the product, in the high pressure separator should be made-up to allow for constant composition of the recycle gas and optimum operating condition of the recycle compressor.

The addition of non-reactive compounds can be performed under intermittent or continuous manner. Process arrangements for performing recycle are not considered novelty by the experts. According to the present invention it is possible to set limits for the concentration of the compound content, with addition and purges being utilized so as to keep the desired concentration.

Still another mode can be the continuous injection and purge of non-reactive compounds, if provided the means for separating the hydrogen from the compounds and recycle hydrogen only.

The process steps of the preferred mode of the invention are described below.

a) contacting in a first reaction stage, under hydrodesulfurization conditions, in a reactor charged with a higher activity hydrorefining catalyst, a naphtha feed with a hydrogen stream and at least one added non-reactive compound, the $H_2$ mole fraction in the mixture of $H_2$ and non-reactive compound being comprised in the range of 0.2 to 1.0, and limiting $H_2S$ at the reactor inlet to not more than 0.1 volume %, so as to yield an effluent;

b) removing $H_2S$ from said first reaction stage effluent so as to obtain a partially hydrodesulfurized naphtha; and c) directing said partially desulfurized naphtha obtained in b) towards a second reaction stage, in a reactor charged with a less active hydrorefining catalyst, under hydrodesulfurization conditions, and contacting said naphtha with a stream of hydrogen and at least one added non-reactive compound, the $H_2$ mole fraction in the mixture of $H_2$ and non-reactive compound being in the range of 0.2 to 0.7, and limiting $H_2S$ at the reactor inlet to not more than 0.05 volume %, to recover a hydrodesulfurized naphtha of improved selectivity as compared to state-of-the-art processes.

Thus, the present invention comprises a two-stage hydrodesulfurization reaction, under usual process conditions, where the feed of olefinic naphtha is made to contact in a first reaction stage a higher activity HDS hydrorefining catalyst and a stream of pure hydrogen or hydrogen and at least one added non-reactive compound, the generated $H_2S$ being removed between the two reaction stages and being preferably utilized nitrogen as a non-reactive compound in the hydrogen stream and at least one added non-reactive compound in the second reaction stage, in lower activity HDS hydrorefining catalyst.

According to all the possible combinations of the present invention process the volume ratio of the hydrogen stream and at least one non-reactive compound added by volume of processed feed should be adjusted in the range of 100 to 1000 $Nm^3/m^3$, preferably of 200 to 800 $Nm^3/m^3$, and more preferably, of 300 to 600 $Nm^3/m^3$ in the final reaction stage.

It is expected that hydrogen and non-reactive compounds make-ups will be required in order to keep the $H_2$ mole fraction of the $H_2$ and non-reactive compounds stream and the volume ratio of the $H_2$ and non-reactive compounds stream by volume of processed feed under the desired conditions of the invention. Analogously, recycle, by-product removal and fluid transport operations are expected, these operations comprising any well-known, state-of-the-art procedures.

$H_2S$ concentration at the first reaction stage reactor inlet is preferably lower than 0.05 volume %.

It is considered that higher than 0.1 volume % levels at the reactor inlet can jeopardize the process selectivity as a function of the significant $H_2S$ recombination with the remaining olefins.

In order to remove $H_2S$ from the first reaction stage effluent any well-known means can be employed, including without being limited to: condensation; separation; distillation; contact of the liquid product countercurrent with gas free from $H_2S$; rectification and absorption with MEA/DEA solutions; adsorption; membranes; and alkaline solution wash.

At the reactor inlet of the second reaction stage, the $H_2S$ concentration should be preferably lower than 0.025 volume %. It is considered that higher than 0.05 volume % levels at the reactor inlet can jeopardize the process selectivity as a function of the significant $H_2S$ recombination with the remaining olefins.

$H_2S$ content in the first stage feed should be lower than 1,000 ppmv, and of the second stage, lower than 500 ppmv. Preferably, the mixture of $H_2$ and the non-reactive compound originates from the gas recycle plus the make-up streams, $H_2S$ removal from the first stage product being required. The recycle can originate either from the first or from the second reaction stages. In case it originates from the second reaction stage and if there is no $H_2S$ removal section in the second reaction stage, the sulfur content of the second reaction stage feed should be such that it does not lead to $H_2S$ content higher than 1,000 ppmv in the first reaction stage feed. Higher $H_2S$ contents in the first reaction stage could lead to the formation of such an amount of mercaptans that it would be hard to obtain a first reaction stage product the sulfur content of which would allow high sulfur removal in the second reaction stage, also as a function of the recombination reaction.

In the particular case of using a non-reactive compound in the second stage only, it is not possible to recycle gas from the second stage to the first one.

Possible arrangements for $H_2S$ removal and stream recycle are well-known, the selected arrangements being those able to attend to the upper limits 0.1 volume % at the reactor inlet in the first hydrodesulfurization reaction stage, and 0.05 volume % $H_2S$ at the reactor inlet of the second reaction stage.

Preferably the stream containing hydrogen and at least one added non-reactive compound originates from the gas recycle effluent from the hydrodesulfurization reaction, either from the first or from the second reaction stages, to said gas recycle being admixed make-up $H_2$ and non-reactive compound streams. Still, the reaction effluent gas recycle operations and $H_2S$ removal can be independent for each stage, chiefly in case different hydrogen and added non-reactive compounds streams are practiced in each reaction stage.

The make-up of added non-reactive compounds in the hydrogen and non-reactive compounds stream is carried out in larger amounts when these compounds are condensed and solubilized in the liquid effluent from the hydrodesulfurization reaction, with possible partial losses in the $H_2S$ removal steps.

When the added non-reactive compounds are condensed and solubilized in the liquid effluent, they can be removed by distillation or by any separation method, as can be part of the hydrodesulfurized naphtha stream recovered in the process, and be added with no harm to the final gasoline pool.

Preferably, the at least one added non-reactive compound is in the vapor phase under the condensation conditions, past the reactor, and in admixture with hydrogen makes the recycle gas.

Some kinds of hydrogen generation can further provide the non-reactive compounds of the present invention. Steam reform to provide the feed of ammonia synthesis units yields a mixture of $N_2$ and $H_2$. It would be possible to work with a make-up stream containing $N_2$ and $H_2$. However, in case the unit includes gas recycle, the composition of the gas recycle varies as a function of the operation conditions of: the liquid separator vessels, the $H_2S$ removal step, resulting in solubility losses, the recycle gas flow rate, and finally the effective hydrogen consumption in the reactor, this being a function of the operation conditions themselves and which will dictate the hydrogen make-up in the reactor. The preferred condition is therefore to possess independent streams of non-reactive compounds and hydrogen make-up. The control of the make-up flow rates is performed so as to make-up the $H_2$ consumed in the reaction and the lost non-reactive compounds, the mole fraction of hydrogen in the $H_2$ and non-reactive compound stream, the $H_2$ and non-reactive compound ratio by feed and pressure being kept under the desired conditions.

Thus, the recycle gas of the first reaction stage should undergo a $H_2S$ removal step before returning to the hydrodesulfurization reactor, so as to adjust the concentration to levels lower than 0.1 volume %.

Means for removing $H_2S$ from the recycle gas can be selected, but not limited to: diethanolamine (DEA) or monoethanolamine (MEA) absorption units or wash with alkaline solutions.

In case the recycle gas is from the second hydrodesulfurization reaction stage and with no $H_2S$ removal step, the concentration of organosulfur compounds in the second reaction stage should be such that it does not entail any increase in the $H_2S$ concentration to values higher than 0.1 volume % at the reactor inlet of the first reaction stage or 0.05 volume % at the reactor inlet of the second reaction stage.

Additionally, it is well known that the high $H_2S$ concentration present in the reaction mixture leads to the recombination reaction of said reaction-generated $H_2S$ with the remaining olefins, yielding mercaptidic compounds. Thus, in the second reaction stage it would be possible to utilize added non-reactive compounds only to promote the conversion reaction of a portion of said mercaptidic compounds, but not the conversion of still present compounds of thiophenic nature, the conversion of which depends on hydrogenation.

The lower activity HDS catalyst to be necessarily employed in the second reaction stage can be manufactured by known means in the art. Without willing to limit the scope of the invention, a preferred lower activity HDS catalyst is that on a basic support.

One method for obtaining the basic support catalyst is described below.

A support consisting from 10 to 90% basic oxide (MgO, CaO, BeO, BaO, SrO, $La_2O_3$, $CeO_2$, $Pr_2O_3$, $Nd_2O_3$, $SmO_2$, $K_2O$, $Cs_2O$, $Rb_2O$, $ZrO_2$) and alumina as balance is manufactured by intensive mixture of alumina hydrate powder with basic hydroxycarbonate powder. The basic hydroxycarbonate powder possesses a lamellar structure of the brucite kind, such as the hydrotalcite-like (HT) material manufactured by Süd-Chemie AG the trade name of which is Sorbacid or Syntal. The Mg:Al ratio in hydrotalcite and in the hydrotalcite:alumina hydrate mixture are varied according to the MgO content desired in the support.

The variations are set forth in Table 1 below.

TABLE 1

| % Sorbacid | $MgO/Al_2O_3$ | Mg/Al mole ratio in Sorbacid: | | | | |
|---|---|---|---|---|---|---|
| in the support | in the support | 0.38 | 0.95 | 2.30 | 7.60 | 500.00 |
| 100 | % MgO | 23.10 | 42.89 | 64.51 | 85.73 | 99.75 |
| | % $Al_2O_3$ | 76.90 | 57.11 | 35.49 | 14.27 | 0.25 |
| 35 | % MgO | 8.08 | 15.01 | 22.58 | 30.00 | 34.91 |
| | % $Al_2O_3$ | 91.92 | 84.99 | 77.42 | 70.00 | 65.09 |
| 12.4 | % MgO | 2.86 | 5.32 | 8.00 | 10.63 | 12.37 |
| | % $Al_2O_3$ | 97.14 | 94.68 | 92.00 | 89.37 | 87.63 |
| 23.3 | % MgO | 5.38 | 9.99 | 15.03 | 19.97 | 23.24 |
| | % $Al_2O_3$ | 94.62 | 90.01 | 84.97 | 80.03 | 76.76 |
| 46.6 | % MgO | 10.76 | 19.98 | 30.06 | 39.95 | 46.48 |
| | % $Al_2O_3$ | 89.24 | 80.02 | 69.94 | 60.05 | 53.52 |
| 57.4 | % MgO | 13.26 | 24.62 | 37.03 | 49.21 | 57.26 |
| | % $Al_2O_3$ | 86.74 | 75.38 | 62.97 | 50.79 | 42.74 |

The homogenization step of the mixture of basic hydroxycarbonate and alumina hydroxide occurs for 5 to 60 minutes, preferably 10 to 30 minutes. Water is added until the mixture turns into a paste. Said paste is fed to an extruder to form extrudates of desired size and geometry.

The extrudates are dried at a temperature from 100 to 160° C. for 1 to 16 h and calcined at 250 to 900° C., preferably 350 to 700° C. for 1 to 16 h.

An impregnation solution is prepared by dissolving heptamolybdate ammonium tetrahydrate in a cobalt basic or acidic solution. The choice of the cobalt salt includes cobalt hydroxide, carbonates, nitrates in ammonium solution, chlorides, nitrates, sulfates or carboxylates such as Co formate or Co acetate. The final Mo/Co mole ratio in the catalyst varies from 0.5 to 10, preferably from 2 to 5. The total amount of $MoO_3$ in the final catalyst varies from 5% to 40%, preferably 10% to 25%.

The concentration of the impregnation solution can be adjusted by using deionized water so that the volume of the solution is the same or less than the total extrudate pore volume. The solution pH is modified with the aid of a base or an acid to obtain the desired point zero charge (PZC). The impregnation solution is then sprinkled on the extrudate so as to allow the homogeneous distribution of the metal on the support. The metal extrudates are then left for 1 to 10 hours to secure the desired metal dispersion on the support.

Finally the extrudates containing the metal (catalyst) are dried from 100 to 160° C. for 1 h to 16 h and calcined between 200° C. and 900° C., preferably between 250° C. to 700° C. for 1 h to 16 h in air or in a controlled atmosphere. The catalyst crystalline phases are submitted to analysis by X-Ray diffraction. The intensity of the CoMo mixed phase between 25° to 30° of the 2θ in the diffraction pattern should be at the same level than the bottom noise, which indicates the amorphous nature of the mixed oxide.

It should be apparent to the experts that such means for preparing a basic support catalyst are described solely for the sake of illustration and as such should not be considered as limiting the scope of the present invention.

The following means are considered as pertaining to the state-of-the-art technique of the present process: (a) heat exchange means that make possible to increase the temperature of the hydrogen and non-reactive compounds stream to the reaction conditions; (b) means for promoting the transport of the reaction mixture to the hydrodesulfurization reactor; (c) means for separating liquid from gaseous products; (d) means for removing $H_2S$ from gaseous and liquid streams; (e) means for recycling $H_2$ streams and at least one added non-reactive compound into the reaction steps; (f) means for keeping the hydrogen mole fraction and the ratio of hydrogen volume and non-reactive compounds by volume of feed within the desired values for the present invention; and (g) means for manufacturing a lower activity HDS catalyst for utilization in the second reaction stage.

Without willing to limit the claims of the present invention to a mechanism of reduced olefin recombination, it is believed that besides the reduction in $H_2S$ concentration of the second reaction stage so as to hinder recombination reactions, the presence of at least one added non-reactive compound reduces hydrogen concentration, inhibiting undesired olefin hydrogenation reactions, without increasing or preferably reducing $H_2S$ concentration.

It is believed further that higher hydrogen concentration in the first reaction stage associated to a more active HDS catalyst or higher activity HDS catalyst can lead to the formation of species that are more readily desulfurizable in the second reactor.

According to the concept of the invention, it is mandatory to utilize non-reactive compound and less active HDS catalyst in the second reaction stage. Still according to the concept of the invention, the $H_2/(H_2+$ non-reactive compound) ratio is higher in the first than in the second reaction stage, it being possible not to utilize any non-reactive compound in the first reaction stage.

Hydrogen consumed in the reaction and feed non-reactive compounds lost by solubilization in the product in any process steps should be replenished so as to keep the gas/feed ratios set forth in process steps a) and b), as well as the $H_2/(H_2+$ non-reactive compound) ratio within the desired conditions.

Finally, hydrodesulfurized FCC naphtha of low sulfur content (preferably lower than 100 ppm) and low olefin hydrogenation degree (preferably less than 40% of the olefins originally present in the feed, preferably less than 30% of the olefins) is obtained.

In order to illustrate the application of the present invention, the conversion degree of organosulfur compounds as well as the hydrogenation of olefins present in the feed of olefinic naphtha streams is set forth by the results of the Examples and Figures described below.

Further interpretations of the nature and the mechanism of the selectivity increase do not alter the novelty of the present invention which will be now illustrated by the following Examples, which should not be construed as limiting same.

EXAMPLES

For the following Examples a gasoil catalytic cracking olefinic naphtha was employed, without further fractioning, the feed having the following features of interest for the invention: sulfur 1,689 mg/kg; olefins 27.0 mass %; and density @ 20/4° C., 0.7598.

The naphtha feed is processed in an isothermal hydrodesulfurization reactor driven by controlled heating zones, the said reactor being charged with 150 mL of commercial catalyst diluted in 150 mL carborundum.

Employed are a 1.3 mm diameter commercial CoMo (4.4 mass % CoO and 17.1 mass % $MoO_3$) catalyst supported on trilobe $Al_2O_3$, and a basic support 1.3 mm diameter catalyst of similar metal content (4 mass % CoO and 16 mass % $MoO_3$). The composition of the basic support includes 20 mass % MgO, with alumina as the balance. The said catalysts are from now on in the present specification designed as more active catalyst (alumina-supported) and less active catalyst (supported on a basic MgO and alumina mixed oxide). It should be apparent to the experts that these catalysts are cited solely for the sake of illustration and as such should not be considered as limiting the scope of the invention.

Before use the catalysts are sulfided according to standard procedures and stabilized with straight distillation naphtha before the processing of the olefinic naphtha feed.

In the reactors, for all tests, the following process parameters are kept at fixed values: gas volume ratio (hydrogen or mixture of hydrogen and nitrogen) by volume of feed at 320 $Nm^3/m^3$, space velocity 4 $h^{-1}$ (volume of feed by hour by volume of catalyst) and pressure at 2.0 MPag.

For the sake of comparison the data for process parameters are set forth at: temperature in the range of 240° C. to 280° C. and $H_2$ mole fraction 1.0 or 0.5 in the hydrogen and added non-reactive compounds stream, for both catalysts.

Finally, the data obtained in two stages, in the presence of hydrogen and nitrogen stream, for both kinds of catalysts are compared to results obtained in two stages with hydrogen only, for both types of catalyst.

Example 1

This Example relates to one-reaction stage state-of-the-art technique, where the hydrodesulfurization process is performed by the contact of the naphtha feed with the higher activity catalyst (supported on alumina) and hydrogen gas, to generate partially desulfurized naphtha for further desulfurization in a second stage.

The feed is processed on alumina-supported CoMo catalyst with a stream of pure hydrogen and temperature controlled at 255° C. throughout the reactor, the remaining conditions being fixed as set forth above.

After $H_2S$ removal from the effluent, the sulfur concentration resulted in 170 mg/kg and that of olefins, 22.3 mass % in the partially desulfurized naphtha, which s equivalent to an extent of 17.4% olefin hydrogenation.

From the sulfur speciation analysis, it could be seen that only 17% of the partially hydrodesulfurized naphtha sulfur correspond to thiophenic compounds present in the feed, while the remaining 83% are probably mercaptidic compounds and sulfides resulting from the recombination reaction.

Example 2

This Example relates to one-reaction stage state-of-the-art, where the hydrodesulfurization process is performed by contacting the naphtha feed with the higher activity HDS catalyst (supported on alumina) and hydrogen and nitrogen gases, in order to yield partially desulfurized naphtha for further desulfurization in a second stage.

The naphtha feed is processed on an alumina-supported CoMo catalyst with $N_2$ and $H_2$ equimolar mixture and controlled temperature at 272° C. throughout the reactor, aiming at the same sulfur content of Example 1, the remaining conditions described above being fixed. Thus, the sulfur content of the first reaction stage products in the hydrodesulfurization with $H_2$ (Example 1) and present Example 3 can be considered as equivalent.

After $H_2S$ removal from the partially hydrodesulfurized naphtha the sulfur concentration resulted in 165 mg/kg and that of the olefins in 22.5 mass %, which is equivalent to 16.9% olefin hydrogenation.

From the sulfur speciation analysis it could be seen that 45 mass % of the sulfur in the partially hydrodesulfurized naphtha correspond to thiophenic species present in the feed, while the remaining 55 mass % are probably mercaptidic compounds and sulfides resulting from the recombination reaction or from partially hydrodesulfurized thiophenic compounds.

Example 3

This Example relates to one-reaction stage state-of-the-art technique where the hydrodesulfurization process is performed by contacting the naphtha feed with a lower activity catalyst (supported on an alumina and magnesia mixed oxide) and hydrogen gas, to generate partially desulfurized naphtha for further desulfurization in a second reaction stage.

The feed is processed on a CoMo catalyst supported on a mixed alumina and magnesium oxide with a stream of pure hydrogen and temperature controlled at 277° C. throughout the reactor, the remaining conditions described before being fixed.

After $H_2S$ removal from the partially hydrodesulfurized naphtha the sulfur concentration resulted in 171 mg/kg and that of the olefins in 21.3 mass %, which is equivalent to a 21.7% olefin hydrogenation.

From the sulfur speciation analysis it could be seen that only 44 mass % of the sulfur in the partially hydrodesulfurized naphtha correspond to thiophenic species present in the feed, while the remaining 56 mass % are probably mercaptidic compounds and sulfides resulting from the recombination reaction.

Example 4

This Example relates to one-reaction stage state-of-the-art technique where the hydrodesulfurization process is performed by contacting the naphtha feed with a lower activity catalyst (supported on a mixed alumina and magnesia oxide) and hydrogen and nitrogen gas, to generate partially desulfurized naphtha for further desulfurization in a second reaction stage.

The naphtha feed is processed on a CoMo catalyst supported on a mixed alumina and magnesium oxide with equimolar mixture of $H_2$ and $N_2$ and temperature controlled at 285° C. throughout the reactor, aiming the same sulfur contents as those of Example 3, the remaining conditions described before being fixed. Thus, the sulfur content of the first reaction stage products, in the hydrodesulfurization with $H_2$ (Example 3) and present Example 4 can be considered as equivalent.

After $H_2S$ removal from the partially hydrodesulfurized naphtha the sulfur concentration resulted in 165 mg/kg and that of the olefins in 21.7 mass %, which is equivalent to a 20.4% olefin hydrogenation.

From the sulfur speciation analysis it could be seen that 53 mass % of the sulfur in the partially hydrodesulfurized naphtha correspond to thiophenic species present in the feed, while the remaining 47 mass % are probably mercaptidic compounds and sulfides resulting from the conversion reaction or from partially hydrodesulfurized thiophenic compounds.

A comparison among the sulfur contents of the first reaction stage products obtained on an alumina-supported catalyst, in the hydrodesulfurization with $H_2$ (Example 1) or with $H_2$+$N_2$ (Example 2), or on a mixed oxide-supported catalyst with $H_2$ (Example 3) or with $H_2$+$N_2$ (Example 4), the sulfur contents in the product in all tests can be considered as equivalent.

The following Examples 5 to 20 refer to the second hydrodesulfurization stage, where the feeds to be employed are those generated in Examples 1 to 4.

Examples 5, 6, 7 and 8 refer to the hydrogenation of the feed generated in Example 1, with or without $H_2$, on an alumina-supported catalyst or on a MgO and alumina mixed oxide-supported catalyst.

Examples 9, 10, 11 and 12 refer to the hydrogenation of the feed generated in Example 2, with or without $H_2$, on an alumina-supported catalyst or on a mixed MgO and alumina oxide supported catalyst.

Examples 13, 14, 15 and 16 refer to the hydrogenation of the feed generated in Example 3, with or without $H_2$, on an alumina-supported catalyst or on a mixed MgO and alumina oxide supported catalyst.

Examples 17, 18, 19 and 20 refer to the hydrogenation of the feed generated in Example 4, with or without $H_2$, on an alumina-supported catalyst or on a mixed MgO and alumina oxide supported catalyst.

Example 5

This Example relates to the state-of-the-art technique where the hydrodesulfurization reaction is performed in two stages, with more active catalyst in both stages, a hydrogen stream being utilized in both stages.

The partially hydrodesulfurized naphtha generated under Example 1 conditions containing 170 mg/kg sulfur and 22.3 mass % olefins is submitted to a second reaction stage, with a pure hydrogen stream, varying the temperatures only, being fixed the remaining process conditions set forth above.

Table 1 below lists the data for sulfur and olefin concentration obtained in the tests for the hydrodesulfurized naphtha recovered after the second hydrodesulfurization stage.

TABLE 1

| | Temperature ° C. | $H_2$ Mole Fraction | Sulfur mg/kg | Olefins mass % |
|---|---|---|---|---|
| Test 1 | 240 | 1.0 | 18 | 19.1 |
| Test 2 | 260 | 1.0 | 9 | 16.1 |
| Test 3 | 280 | 1.0 | 4 | 11.7 |

Example 6

This Example relates to the state-of-the-art process where the hydrodesulfurization reaction is performed in two stages, with more active catalyst in both stages, a stream of hydrogen and at least one non-reactive compound being utilized in the second stage only.

The partially hydrodesulfurized naphtha generated under Example 1 conditions containing 170 mg/kg sulfur and 22.3 mass % olefins is submitted to a second reaction stage, with an equimolar $H_2$ and $N_2$ stream, and varying the temperatures only, being fixed the remaining process conditions set forth above.

Table 2 below lists the data for sulfur and olefin concentration obtained in the tests for the hydrodesulfurized naphtha recovered after the second hydrodesulfurization stage.

TABLE 2

| | Temperature ° C. | $H_2$ Mole Fraction | Sulfur mg/kg | Olefins mass % |
|---|---|---|---|---|
| Test 1 | 240 | 0.5 | 22 | 20.7 |
| Test 2 | 260 | 0.5 | 12 | 19.0 |
| Test 3 | 280 | 0.5 | 6 | 16.4 |

Example 7

This Example relates to the state-of-the-art process where the hydrodesulfurization reaction is performed in two stages, with more active catalyst in the first stage and less active catalyst in the second stage, a hydrogen stream being utilized in both reaction stages.

The partially hydrodesulfurized naphtha generated under Example 1 conditions containing 170 mg/kg sulfur and 22.3 mass % olefins is submitted to a second reaction stage, with a $H_2$ stream, and varying the temperatures only, being fixed the remaining process conditions set forth above.

Table 3 below lists the data for sulfur and olefin concentration obtained in the tests for the hydrodesulfurized naphtha recovered after the second hydrodesulfurization stage.

TABLE 3

| | Temperature ° C. | $H_2$ Mole Fraction | Sulfur mg/kg | Olefins mass % |
|---|---|---|---|---|
| Test 1 | 240 | 1.0 | 33 | 21.4 |
| Test 2 | 260 | 1.0 | 16 | 19.7 |
| Test 3 | 280 | 1.0 | 8 | 17.1 |

Example 8

This Example relates to the process of the present invention where the hydrodesulfurization reaction is performed in two stages with more active catalyst in the first stage and less active catalyst in the second stage, a stream of hydrogen plus at least one added non-reactive compound being utilized in the second stage only.

The partially hydrodesulfurized naphtha generated under Example 1 conditions containing 170 mg/kg sulfur and 22.3 mass % olefins is submitted to a second reaction stage, with a equimolar $H_2$+$N_2$ stream, and varying the temperatures only, being fixed the remaining process conditions set forth above.

Table 4 below lists the data for sulfur and olefin concentration obtained in the tests for the hydrodesulfurized naphtha recovered after the second hydrodesulfurization stage.

TABLE 4

| | Temperature ° C. | $H_2$ Mole Fraction | Sulfur mg/kg | Olefins mass % |
|---|---|---|---|---|
| Test 1 | 240 | 0.5 | 34 | 21.5 |
| Test 2 | 260 | 0.5 | 16 | 20.1 |
| Test 3 | 280 | 0.5 | 8 | 18.2 |

Example 9

This Example relates to the state-of-the-art process where the hydrodesulfurization reaction is performed in two stages, with more active catalyst in both stages, a stream of hydrogen and at least one non-reactive compound being utilized in the first stage only.

The partially hydrodesulfurized naphtha generated under Example 2 conditions containing 165 mg/kg sulfur and 22.5 mass % olefins is submitted to a second reaction stage, with a $H_2$ stream, varying the temperatures only, being fixed the remaining process conditions set forth hereinbefore.

Table 5 below lists the data for sulfur and olefin concentration obtained in the tests for the hydrodesulfurized naphtha recovered after the second hydrodesulfurization stage.

TABLE 5

| | Temperature ° C. | $H_2$ Mole Fraction | Sulfur mg/kg | Olefins mass % |
|---|---|---|---|---|
| Test 1 | 240 | 1.0 | 18 | 19.3 |
| Test 2 | 260 | 1.0 | 9 | 16.2 |
| Test 3 | 280 | 1.0 | 4 | 11.8 |

Example 10

This Example relates to the state-of-the-art process where the hydrodesulfurization reaction is performed in two stages, with more active catalyst in both reaction stages, a stream of hydrogen and at least one non-reactive compound being utilized in both reaction stages.

The partially hydrodesulfurized naphtha generated under Example 2 conditions containing 165 mg/kg sulfur and 22.5 mass % olefins is submitted to a second reaction stage, with an equimolar $H_2$ and $N_2$ stream, varying the temperatures only, being fixed the remaining process conditions set forth above.

Table 6 below lists the data for sulfur and olefin concentration obtained in the tests for the hydrodesulfurized naphtha recovered after the second hydrodesulfurization stage.

TABLE 6

| | Temperature ° C. | $H_2$ Mole Fraction | Sulfur mg/kg | Olefins mass % |
|---|---|---|---|---|
| Test 1 | 240 | 0.5 | 28 | 20.9 |
| Test 2 | 260 | 0.5 | 14 | 19.2 |
| Test 3 | 280 | 0.5 | 6 | 16.6 |

Example 11

This is an alternative Example, where the hydrodesulfurization reaction is performed in two stages, with the less active catalyst in the second reaction stage, a stream of hydrogen plus at least one non-reactive compound being used in the first reaction stage only.

The partially hydrodesulfurized naphtha generated under Example 2 conditions containing 165 mg/kg sulfur and 22.5 mass % olefins is submitted to a second reaction stage on a MgO and $Al_2O_3$ mixed oxide-supported CoMo catalyst, with a $H_2$ stream, varying the temperatures only, being fixed the remaining process conditions set forth hereinbefore.

Table 7 below lists the data for sulfur and olefin concentration obtained in the tests for the hydrodesulfurized naphtha recovered after the second hydrodesulfurization stage.

TABLE 7

| | Temperature ° C. | $H_2$ Mole Fraction | Sulfur mg/kg | Olefins mass % |
|---|---|---|---|---|
| Test 1 | 240 | 1.0 | 57 | 21.6 |
| Test 2 | 260 | 1.0 | 23 | 19.9 |
| Test 3 | 280 | 1.0 | 9 | 17.3 |

Example 12

This Example relates to the process of the present invention where the hydrodesulfurization reaction is performed in two stages, with less active catalyst in the second reaction stage, a hydrogen stream plus at least one non-reactive compound being utilized in both reaction stages.

The partially hydrodesulfurized naphtha generated under Example 2 conditions containing 165 mg/kg sulfur and 22.5 mass % olefins is submitted to a second reaction stage on a mixed oxide MgO and $Al_2O_3$-supported CoMo catalyst, with an equimolar $H_2$+$N_2$ stream, varying the temperatures only, being fixed the remaining process conditions set forth hereinbefore.

Table 8 below lists the data for sulfur and olefin concentration obtained in the tests for the hydrodesulfurized naphtha recovered after the second hydrodesulfurization stage.

TABLE 8

| | Temperature ° C. | $H_2$ Mole Fraction | Sulfur mg/kg | Olefins mass % |
|---|---|---|---|---|
| Test 1 | 240 | 0.5 | 61 | 21.8 |
| Test 2 | 260 | 0.5 | 27 | 20.4 |
| Test 3 | 280 | 0.5 | 11 | 18.4 |

Example 13

This Example relates to the state-of-the-art process where the hydrodesulfurization reaction is performed in two stages, with less active catalyst in the first reaction stage, a stream of pure hydrogen being utilized in both reaction stages.

The partially hydrodesulfurized naphtha generated on less active catalyst under the conditions of Example 3, containing 171 mg/kg Sulfur and 21.3 mass % olefins is submitted to a second reaction stage, on a $Al_2O_3$-supported CoMo catalyst, using a $H_2$ stream, and varying the temperatures only, being fixed the remaining process conditions set forth hereinbefore.

Table 9 below lists the data for sulfur and olefin concentration obtained in the tests for the hydrodesulfurized naphtha recovered after the second hydrodesulfurization stage.

TABLE 9

| | Temperature ° C. | $H_2$ Mole Fraction | Sulfur mg/kg | Olefins mass % |
|---|---|---|---|---|
| Test 1 | 240 | 1.0 | 18 | 18.3 |
| Test 2 | 260 | 1.0 | 9 | 15.4 |
| Test 3 | 280 | 1.0 | 4 | 11.2 |

Example 14

This is an alternative Example, where the hydrodesulfurization reaction is performed in two stages, with the less active catalyst in the first reaction stage, and using a stream of pure hydrogen and at least one non-reactive compound added to the second reaction stage.

The partially hydrodesulfurized naphtha on less active catalyst generated under the conditions of Example 3, containing 171 mg/kg Sulfur and 21.3 mass % olefins is submitted to a second reaction stage on $Al_2O_3$-supported CoMo catalyst, using an equimolar $H_2$+$N_2$ stream, and varying the temperatures only, the remaining process conditions set forth hereinbefore being fixed.

Table 10 below lists the data for sulfur and olefin concentration obtained in the tests for the hydrodesulfurized naphtha recovered after the second hydrodesulfurization stage.

TABLE 10

| | Temperature ° C. | $H_2$ Mole Fraction | Sulfur mg/kg | Olefins mass % |
|---|---|---|---|---|
| Test 1 | 240 | 0.5 | 28 | 19.8 |
| Test 2 | 260 | 0.5 | 14 | 18.2 |
| Test 3 | 280 | 0.5 | 6 | 15.7 |

Example 15

This Example relates to the state-of-the-art process where the hydrodesulfurization reaction is performed in two stages, with less active catalyst in both reaction stages, a stream of pure hydrogen being utilized in both reaction stages.

The partially hydrodesulfurized naphtha generated under Example 3 conditions containing 171 mg/kg sulfur and 21.3 mass % olefins is submitted to a second reaction stage in a MgO and $Al_2O_3$ mixed oxide-supported CoMo catalyst, with a $H_2$ stream, varying the temperatures only, being fixed the remaining process conditions set forth hereinbefore.

Table 11 below lists the data for sulfur and olefin concentration obtained in the tests for the hydrodesulfurized naphtha recovered after the second hydrodesulfurization stage.

TABLE 11

| | Temperature ° C. | $H_2$ Mole Fraction | Sulfur mg/kg | Olefins mass % |
|---|---|---|---|---|
| Test 1 | 240 | 1.0 | 59 | 20.6 |
| Test 2 | 260 | 1.0 | 24 | 18.9 |
| Test 3 | 280 | 1.0 | 10 | 16.4 |

Example 16

This Example relates to the state-of-the-art process (Brazilian PI BR 0502040-9, of the Applicant and cited hereinbefore) where the hydrodesulfurization reaction is performed in two stages, with less active catalyst in both reaction stages, a stream of pure hydrogen and at least one non-reactive compound being added to the second reaction stage.

The partially hydrodesulfurized naphtha generated under Example 3 conditions containing 171 mg/kg sulfur and 21.3 mass % olefins is submitted to a second reaction stage in a MgO and $Al_2O_3$ mixed oxide -supported CoMo catalyst, with an equimolar $H_2$ and $N_2$ stream, varying the temperatures only, being fixed the remaining process conditions set forth hereinbefore.

Table 12 below lists the data for sulfur and olefin concentration obtained in the tests for the hydrodesulfurized naphtha recovered after the second hydrodesulfurization stage.

TABLE 12

| | Temperature ° C. | $H_2$ Mole Fraction | Sulfur mg/kg | Olefins mass % |
|---|---|---|---|---|
| Test 1 | 240 | 0.5 | 63 | 20.7 |
| Test 2 | 260 | 0.5 | 28 | 19.3 |
| Test 3 | 280 | 0.5 | 11 | 17.5 |

Example 17

This Example relates to the state-of-the-art process where the hydrodesulfurization reaction is performed in two stages, with less active catalyst in the first reaction stage, a stream of pure hydrogen and at least one non-reactive compound being added to the first reaction stage.

The partially hydrodesulfurized naphtha generated under Example 4 conditions containing 165 mg/kg sulfur and 21.7 mass % olefins is submitted to a second reaction stage in a $Al_2O_3$ oxide -supported CoMo catalyst, with a $H_2$ stream, varying the temperatures only, being fixed the remaining process conditions set forth hereinbefore.

Table 13 below lists the data for sulfur and olefin concentration obtained in the tests for the hydrodesulfurized naphtha recovered after the second hydrodesulfurization stage.

TABLE 13

| | Temperature ° C. | $H_2$ Mole Fraction | Sulfur mg/kg | Olefins mass % |
|---|---|---|---|---|
| Test 1 | 240 | 1.0 | 18 | 18.6 |
| Test 2 | 260 | 1.0 | 9 | 15.6 |
| Test 3 | 280 | 1.0 | 4 | 11.4 |

Example 18

This Example relates to the state-of-the-art process where the hydrodesulfurization reaction is performed in two stages, with less active catalyst in the first reaction stage, a stream of pure hydrogen and at least one non-reactive compound being added to both reaction stages.

The partially hydrodesulfurized naphtha generated under Example 4 conditions containing 165 mg/kg sulfur and 21.7 mass % olefins is submitted to a second reaction stage in a $Al_2O_3$ oxide-supported CoMo catalyst, with an equimolar $H_2$+$N_2$ stream, varying the temperatures only, being fixed the remaining process conditions set forth hereinbefore.

Table 14 below lists the data for sulfur and olefin concentration obtained in the tests for the hydrodesulfurized naphtha recovered after the second hydrodesulfurization stage.

TABLE 14

| | Temperature ° C. | $H_2$ Mole Fraction | Sulfur mg/kg | Olefins mass % |
|---|---|---|---|---|
| Test 1 | 240 | 0.5 | 30 | 20.1 |
| Test 2 | 260 | 0.5 | 14 | 18.5 |
| Test 3 | 280 | 0.5 | 6 | 16.0 |

Example 19

This Example relates to the state-of-the-art process where the hydrodesulfurization reaction is performed in two stages, with less active catalyst in both reaction stages, a stream of pure hydrogen and at least one added non-reactive compound being utilized in the first reaction stage.

The partially hydrodesulfurized naphtha on less active catalyst generated under Example 4 conditions containing 165 mg/kg sulfur and 21.7 mass % olefins is submitted to a second reaction stage in a MgO and $Al_2O_3$ mixed oxide-supported CoMo catalyst, with a $H_2$ stream, varying the temperatures only, being fixed the remaining process conditions set forth hereinbefore.

Table 15 below lists the data for sulfur and olefin content obtained in the tests for the hydrodesulfurized naphtha recovered after the second hydrodesulfurization stage.

TABLE 15

| | Temperature ° C. | $H_2$ Mole Fraction | Sulfur mg/kg | Olefins mass % |
|---|---|---|---|---|
| Test 1 | 240 | 1.0 | 65 | 20.9 |
| Test 2 | 260 | 1.0 | 25 | 19.3 |
| Test 3 | 280 | 1.0 | 10 | 16.7 |

Example 20

This Example relates to the state-of-the-art process where the hydrodesulfurization reaction is performed in two stages, with less active catalyst in both reaction stages, a stream of pure hydrogen and at least one added non-reactive compound being utilized in both reaction stages.

The partially hydrodesulfurized naphtha on less active catalyst generated under Example 4 conditions containing 165 mg/kg sulfur and 21.7 mass % olefins is submitted to a second reaction stage on a MgO and $Al_2O_3$ mixed oxide-supported CoMo catalyst, with an equimolar $H_2$+$N_2$ stream, varying the temperatures only, the remaining process conditions set forth hereinbefore being fixed.

Table 16 below lists the data for sulfur and olefin content obtained in the tests for the hydrodesulfurized naphtha recovered after the second hydrodesulfurization stage.

TABLE 16

| | Temperature ° C. | $H_2$ Mole Fraction | Sulfur mg/kg | Olefins mass % |
|---|---|---|---|---|
| Test 1 | 240 | 0.5 | 69 | 21.0 |
| Test 2 | 260 | 0.5 | 30 | 19.7 |
| Test 3 | 280 | 0.5 | 12 | 17.8 |

Example 21

This is a comparative Example related to the state-of-the-art technique in one reaction stage, with the more active catalyst, alumina-supported CoMo, under a hydrogen atmosphere.

The following process parameters have been kept fixed: gas volume ratio (hydrogen) by feed volume, 320 $Nm^3/m^3$; space velocity 2 $h^{-1}$ (volume of feed by hour by catalyst volume) and pressure 2.0 MPag. For the sake of comparison, the space velocity is equal to the sum of the velocities for the two stages. Reaction temperatures are varied, with the sulfur and olefin conversion figures being set forth in Table 17 below.

TABLE 17

| | Temperature ° C. | $H_2$ Mole Fraction | Sulfur mg/kg | Olefins mass % |
|---|---|---|---|---|
| Test 1 | 270 | 1.0 | 56 | 11.3 |
| Test 2 | 280 | 1.0 | 29 | 7.6 |
| Test 3 | 290 | 1.0 | 13.4 | 4.5 |
| Test 4 | 300 | 1.0 | 5 | 2.3 |

Example 22

This is a comparative Example related to the state-of-the-art technique in one reaction stage, with the more active catalyst, alumina-supported CoMo, under a hydrogen atmosphere and at least one added non-reactive compound.

The following process parameters have been kept fixed: gas volume ratio (equimolar mixture of hydrogen and nitrogen) by feed volume, 320 $Nm^3/m^3$; space velocity 2 $h^{-1}$ (volume of feed by hour by catalyst volume) and pressure 2.0 MPag. For the sake of comparison, the space velocity is equal to the sum of the velocities for the two stages. Reaction temperatures are varied, with the sulfur and olefin conversion figures being set forth in Table 18 below.

TABLE 18

| | Temperature ° C. | $H_2$ Mole Fraction | Sulfur mg/kg | Olefins mass % |
|---|---|---|---|---|
| Test 1 | 270 | 0.5 | 91.5 | 18.5 |
| Test 2 | 280 | 0.5 | 57.4 | 15.6 |
| Test 3 | 290 | 0.5 | 35 | 12.6 |
| Test 4 | 300 | 0.5 | 20 | 9.6 |

Example 23

This is a comparative Example related to the state-of-the-art technique in one reaction stage, with the less active catalyst, MgO-alumina mixed oxide-supported CoMo, under a hydrogen atmosphere.

The following process parameters have been kept fixed: gas volume ratio (hydrogen) by feed volume, 320 $Nm^3/m^3$; space velocity 2 $h^{-1}$ (volume of feed by hour by catalyst volume) and pressure 2.0 MPag. For the sake of comparison, the space velocity is equal to the sum of the velocities for the two stages. Reaction temperatures are varied, with the sulfur and olefin conversion figures being set forth in Table 19 below.

TABLE 19

| | Temperature ° C. | $H_2$ Mole Fraction | Sulfur mg/kg | Olefins mass % |
|---|---|---|---|---|
| Test 1 | 270 | 1.0 | 123 | 20.1 |
| Test 2 | 280 | 1.0 | 78 | 16.9 |
| Test 3 | 290 | 1.0 | 49.5 | 14.2 |
| Test 4 | 300 | 1.0 | 32.1 | 12.1 |

Example 24

This is a comparative Example related to the state-of-the-art technique in one reaction stage, with the less active catalyst, MgO-alumina mixed oxide-supported CoMo, under a hydrogen atmosphere and at least one added non-reactive compound.

The following process parameters have been kept fixed: gas volume ratio (equimolar mixture of hydrogen and nitrogen) by feed volume, 320 $Nm^3/m^3$; space velocity 2 $h^{-1}$ (volume of feed by hour by catalyst volume) and pressure 2.0 MPag. For the sake of comparison, the space velocity is equal to the sum of the velocities for the two stages. Reaction temperatures are varied, with the sulfur and olefin conversion figures being set forth in Table 20 below.

TABLE 20

| | Temperature ° C. | $H_2$ Mole Fraction | Sulfur mg/kg | Olefins mass % |
|---|---|---|---|---|
| Test 1 | 280 | 0.5 | 92 | 19.5 |
| Test 2 | 290 | 0.5 | 58 | 17.5 |
| Test 3 | 300 | 0.5 | 42 | 16.1 |
| Test 4 | 310 | 0.5 | 30 | 15.4 |

Example 25

This final Example relates to the process of the present invention where the hydrodesulfurization reaction is performed in two stages, with the more active catalyst in the first stage and the less active catalyst in the second stage, a stream of hydrogen plus at least one added non-reactive compound in both reaction stages, with the $H_2$ content being higher in the first than in the second stage.

The naphtha stream is partially hydrodesulfurized in a first reaction stage containing the more active catalyst, $Al_2O_3$-supported CoMo, and gas fed at 0.75 $H_2/(H_2+N_2)$ ratio and 260° C. temperature. The sulfur content of the naphtha resulting from hydrodesulfurization is 176 ppm and the olefin content is 22.7 mass %.

After $H_2S$ removal the naphtha stream is processed in the second reaction stage containing a less active catalyst, a MgO and $Al_2O_3$ mixed oxide-supported CoMo and gas fed at 0.25 $H_2/(H_2+N_2)$ ratio and 260° C., 280° C. and 300° C. temperatures.

The following process parameters have been kept fixed in both reactors: gas volume ratio (hydrogen or mixture of hydrogen and nitrogen) by feed volume, 320 $Nm^3/m^3$; space velocity 4 $h^{-1}$ (volume of feed by hour by catalyst volume) and pressure 2.0 MPag.

Table 21 below lists the data for sulfur and olefin content obtained in the tests for the hydrodesulfurized naphtha recovered after the second hydrodesulfurization stage.

TABLE 21

| | Temperature ° C. | $H_2$ Mole Fraction | Sulfur mg/kg | Olefins mass % |
|---|---|---|---|---|
| Stage 1 | 260 | 0.75 | 176 | 22.7 |
| Test 1 | 260 | 0.25 | 27 | 21.0 |
| Test 2 | 280 | 0.25 | 12.2 | 19.7 |
| Test 3 | 300 | 0.25 | 7.6 | 18.9 |

Examples 1 to 4 refer to the possible hydrodesulfurization arrangements in one reaction stage, on a more active or less active catalyst, and in the presence or not of added $N_2$. Following Examples 5 to 20 refer to the possible treatment combinations of the four starting feeds, resulting from Examples 1 to 4, on two catalysts and in the presence or not of added $N_2$.

State-of-the-art technique Examples are those that utilize a more active and/or a less active catalyst, in two stages, without the addition of a non-reactive compound. Thus, are Examples of the state-of-the-art in two stages, using hydrogen only, HDS on more active catalyst and hydrogen, Example 5, HDS on more active catalyst and then on less active catalyst, Example 7; the less active catalyst followed by the more active catalyst, Example 13, or less active, selective catalyst, in both reaction stages and hydrogen, Example 15.

Examples referring to the state-of-the-art involving the utilization of non-reactive compounds in two stages, corresponding to a previous application of the Applicant, involve the utilization of non-reactive compound added in one or more stages, the same catalyst being employed in both reaction stages. Thus, exemplary of such state-of-the-art technique in two reaction stages and utilization of added non-reactive compound are Example 6, with the more active catalyst in both stages and non-reactive compound added in the final stage only, Example 9, more active catalyst and utilization of added non-reactive compound in the first stage only, Example 10, more active catalyst and utilization of non-reactive compound in both reaction stages. The less active catalyst is utilized in Example 16, non-reactive compound in the final reaction stage, Example 19 the added non-reactive compound is utilized in the first reaction stage, and Example 20 utilizes the added non-reactive compound in both reaction stages.

Further possible arrangements other than the state-of-the-art setups are the utilization of distinct catalysts in both reaction stages and employing at least one added non-reactive compound. Examples of such setups with the more active catalyst before the less active catalyst are Examples 8, 11 and 12, respectively with non-reactive compound in the second, first and in both stages. The remaining Examples refer to arrangements made up with the less active catalyst before the more active catalyst, according to Examples 14, 17 and 18, respectively with non-reactive compound in the second, first and in both stages.

FIGS. 1 to 4 are graphs illustrating the selectivity curves related to Examples 5 to 20, being combined in each Figure the tests for the Examples made from the same conditions in the first stage—same catalyst and composition of fed gas ($H_2$ or $H_2+N_2$).

As evidenced from FIG. 1, it is demonstrated that, for the first HDS stage performed on a more active catalyst, such as those usually employed in the hydrorefining practice, and by just adding $H_2$, the worse selectivity is attained if the same condition is practiced in the second stage. More selective conditions are reached for a less active catalyst in the second stage (Example 7) or by adding non-reactive compound with the same first stage catalyst (Example 6). The higher selectivity condition, however, by utilizing a more active catalyst and $H_2$ only in the first stage, is to use the less active catalyst and a mixture of $H_2$ and non-reactive compound added to the second stage (Example 8). By selectivity is meant, as stated hereinbefore, to reach desired sulfur contents for the product while olefin hydrogenation is kept at the lowest possible level.

Figure 2:
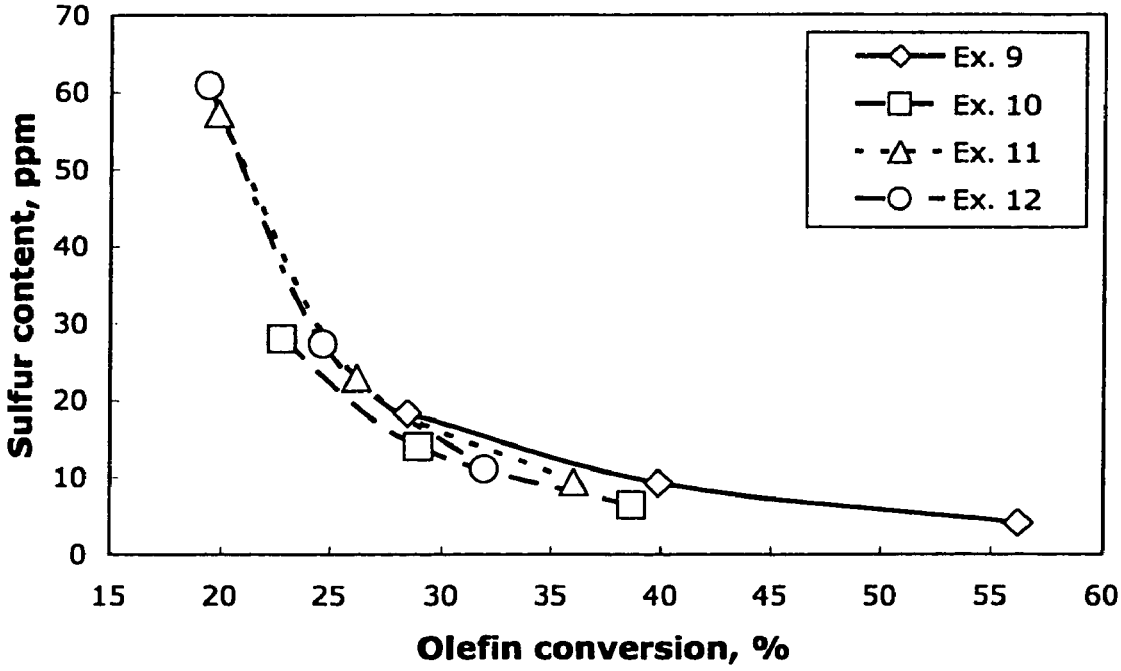
FIG. 2 attached is a graph that illustrates the effect, in the second hydrodesulfurization stage, of the catalyst nature and of the presence of nitrogen on hydrodesulfurization and olefin hydrogenation of a naphtha feed which has been previously desulfurized in a first reaction stage on a more active HDS catalyst in the presence of a hydrogen stream and a nitrogen stream (described below in Example 2), with $H_2S$ removal between two stages, according to Examples 9 to 12.

FIG. 2 is a graph illustrating the possible HDS combinations in two stages, with the first stage being the more active catalyst with non-reactive compound added to hydrogen. Example 9, with more active catalyst and $H_2$ only in the final stage is the less selective, showing the highest olefin conversion for same sulfur level in the product (nearly 10 ppm). Example 10 is the more selective, the more active catalyst being utilized and the non-reactive compound being added to both reaction stages.

Figure 3:
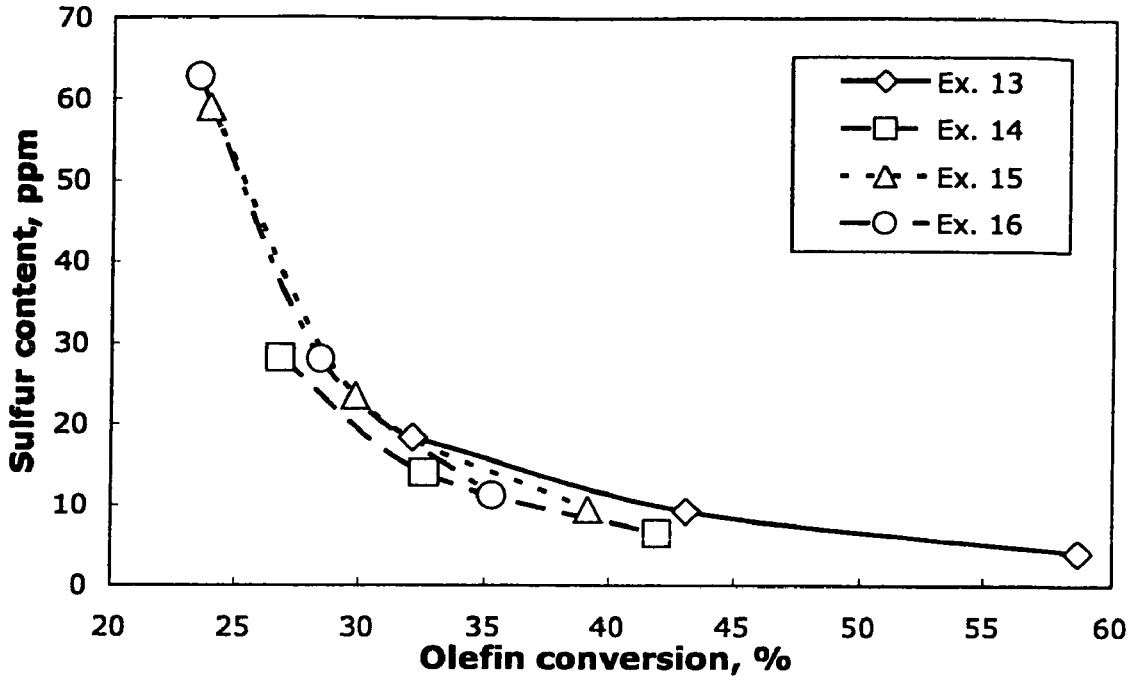
FIG. 3 attached is a graph that illustrates the effect, in the second hydrodesulfurization stage, of the catalyst nature and of the presence of nitrogen on hydrodesulfurization and olefin hydrogenation of a naphtha feed which has been previously desulfurized in a first reaction stage on a less active HDS catalyst in the presence of a hydrogen stream (described below in Example 3), with $H_2S$ removal between two stages, according to Examples 13 to 16.

FIG. 3 is a graph showing the possible combinations for HDS in two stages, with the first stage on the less active catalyst without any non-reactive compound added to hydrogen (pure $H_2$). Example 13, with more active catalyst and $H_2$ only in the final stage is the less selective, showing the higher olefin conversion for same sulfur level in the product (nearly 10 ppm). Example 14 is the more selective, with the more active catalyst being utilized and the addition of non-reactive compound in the second reaction stage—in spite of the fact that Examples 15 and 16 bear the same selectivity under the highest severity condition.

Figure 4:
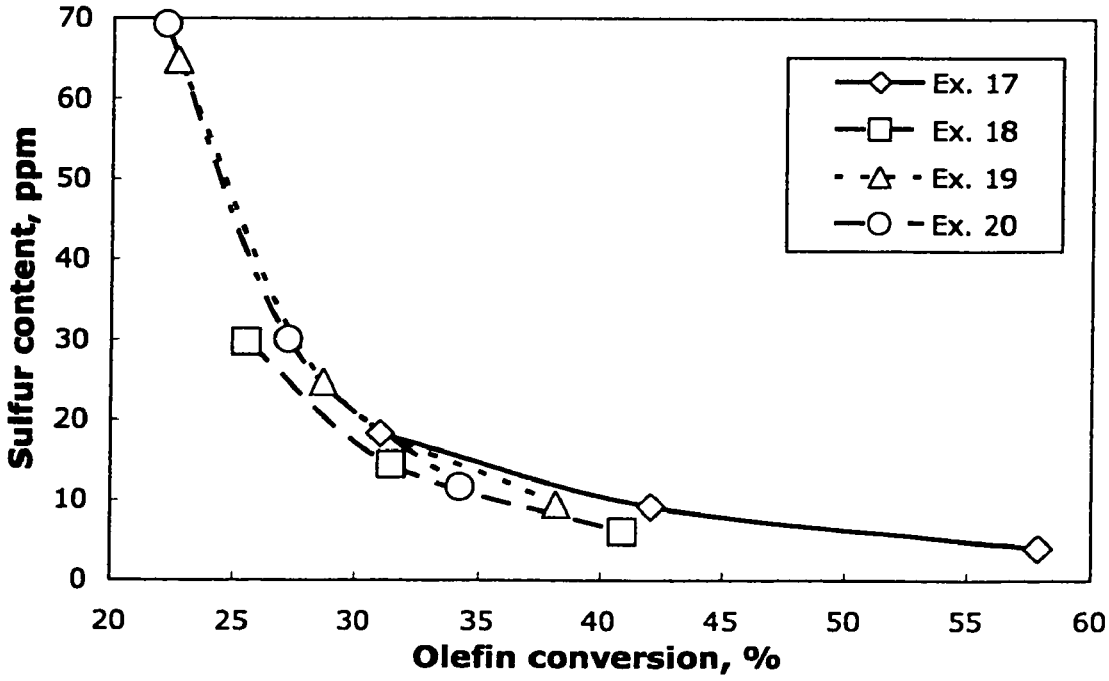
FIG. 4 attached is a graph that illustrates the effect, in the second hydrodesulfurization stage, of the catalyst nature and of the presence of nitrogen on hydrodesulfurization and olefin hydrogenation of a naphtha feed which has been previously desulfurized in a first reaction stage on a less active HDS catalyst in the presence of a hydrogen stream and a nitrogen stream (described below in Example 4), with $H_2S$ removal between two stages, according to Examples 17 to 20.

FIG. 4 is a graph illustrating the HDS possible combinations in two stages, with the less active catalyst in the first stage with non-reactive compound added to hydrogen ($H_2$+$N_2$).

Example 17, with more active catalyst and $H_2$ only on the final stage is the less selective, showing highest olefin conversion for same sulfur level in the product (nearly 10 ppm). Example 18 is the more selective, using the more active catalyst and the addition of non-reactive compound in both reaction stages—in spite of the fact that Examples 19 and 20 are of similar selectivity under the highest severity condition.

FIGS. 5 to 8 are graphs representing the selectivity curves related to Examples 5 to 20, being combined in each Figure the tests for the Examples having the same second stage conditions—same catalyst and composition of the gas fed to the reaction system ($H_2$ or $H_2$+$N_2$).

Figure 5:
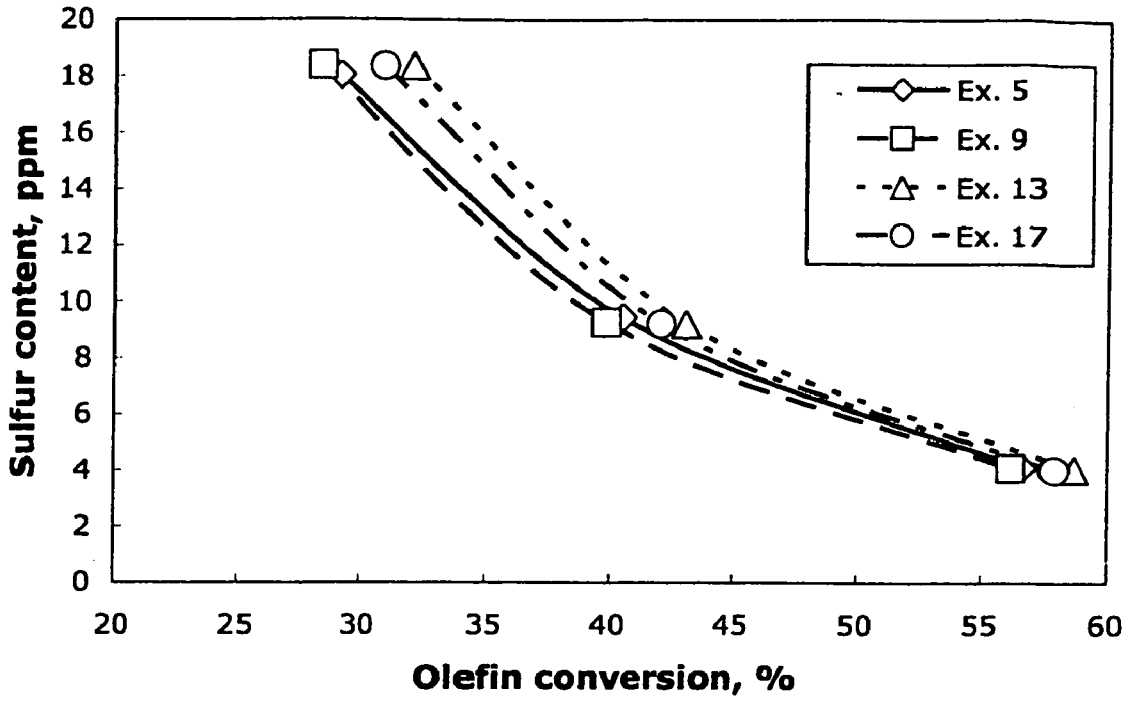
FIG. 5 attached is a graph that illustrates the effect of the catalyst nature and the presence of nitrogen in the first reaction stage on hydrodesulfurization and olefin hydrogenation in the second hydrodesulfurization stage, a more active HDS catalyst and pure hydrogen stream being employed in the second reaction stage, with $H_2S$ removal between the two stages according to Examples 5, 9, 13 and 17.

FIG. 5 is a graph illustrating the possible combinations for HDS in two stages, the second stage utilizing the more active catalyst and pure hydrogen. Example 5, with more active catalyst and $H_2$ only in both stages is the less selective, showing highest olefin conversions for same sulfur level in the product (nearly 10 ppm). Example 17 is the most selective, the less active catalyst and added non-reactive compound being utilized in the first reaction stage.

Figure 6:
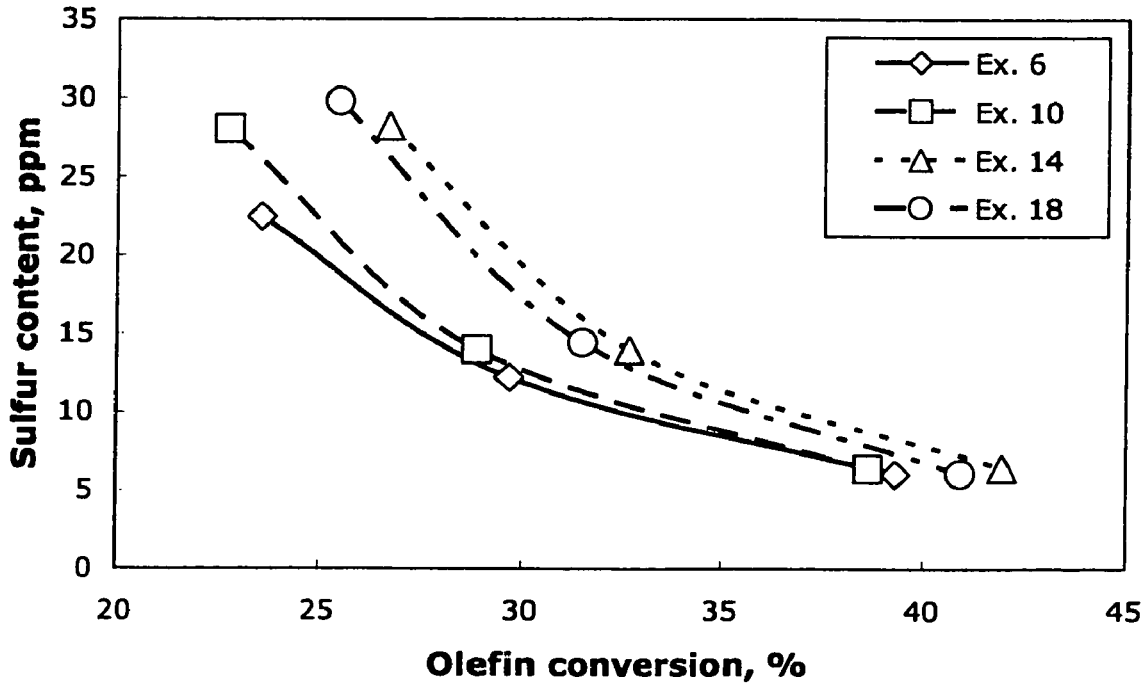
FIG. 6 attached is a graph that illustrates the effect of the catalyst nature and the presence of nitrogen in the first reaction stage on hydrodesulfurization and olefin hydrogenation in the second hydrodesulfurization stage, a more active HDS catalyst and equimolar hydrogen and nitrogen stream being employed in the second reaction stage, with $H_2S$ removal between the two stages according to Examples 6, 10, 14 and 18.

FIG. 6 is a graph illustrating the possible HDS combinations in two stages, the second stage utilizing the more active catalyst and non-reactive compound added to hydrogen. Example 14, with less active catalyst and $H_2$ only in the first stage is the less selective, showing highest olefin conversion for same sulfur level in the product. It can be considered that Example 6 is the more selective, by utilizing the less active catalyst and the added non-reactive compound in the first reaction stage.

Figure 7:
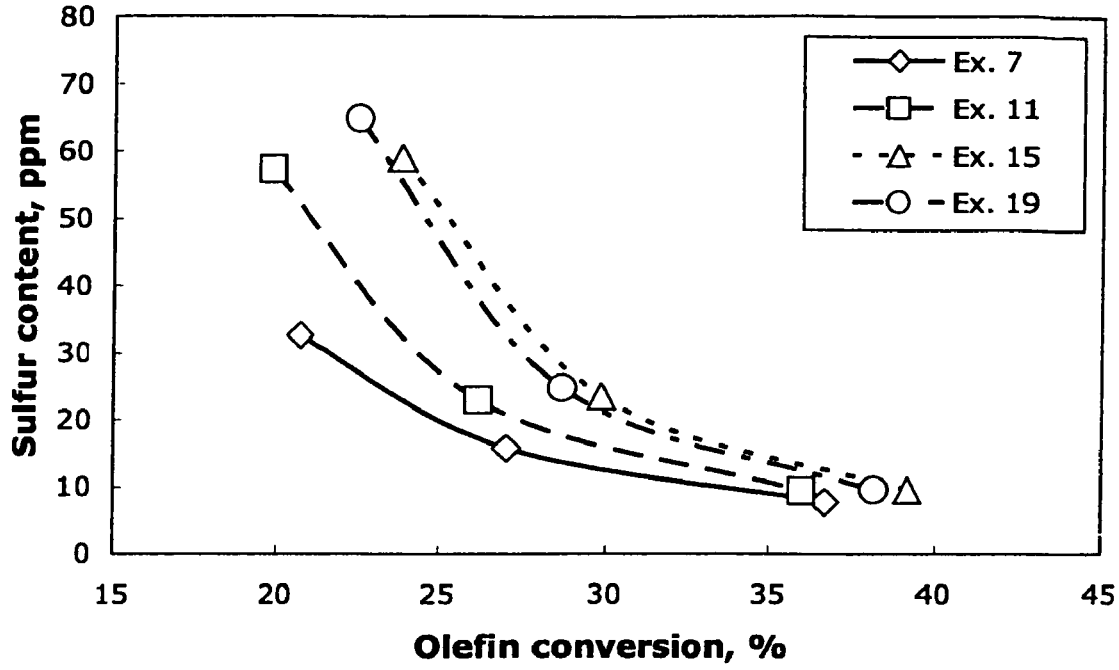
FIG. 7 attached is a graph that illustrates the effect of the catalyst nature and the presence of nitrogen in the first reaction stage on hydrodesulfurization and olefin hydrogenation in the second hydrodesulfurization stage, a less active HDS catalyst and pure hydrogen stream being employed in the second reaction stage, with $H_2S$ removal between the two stages according to Examples 7, 11, 15 and 19.

FIG. 7 is a graph illustrating the possible HDS combinations for HDS in two stages, the second stage utilizing the less active catalyst and hydrogen only, without the addition of non-reactive compound. Example 15, with less active catalyst and $H_2$ only in the first stage is the less selective. It can be considered that Example 7 is the more selective, utilizing more active catalyst and $H_2$ only in the first reaction stage.

Figure 8:
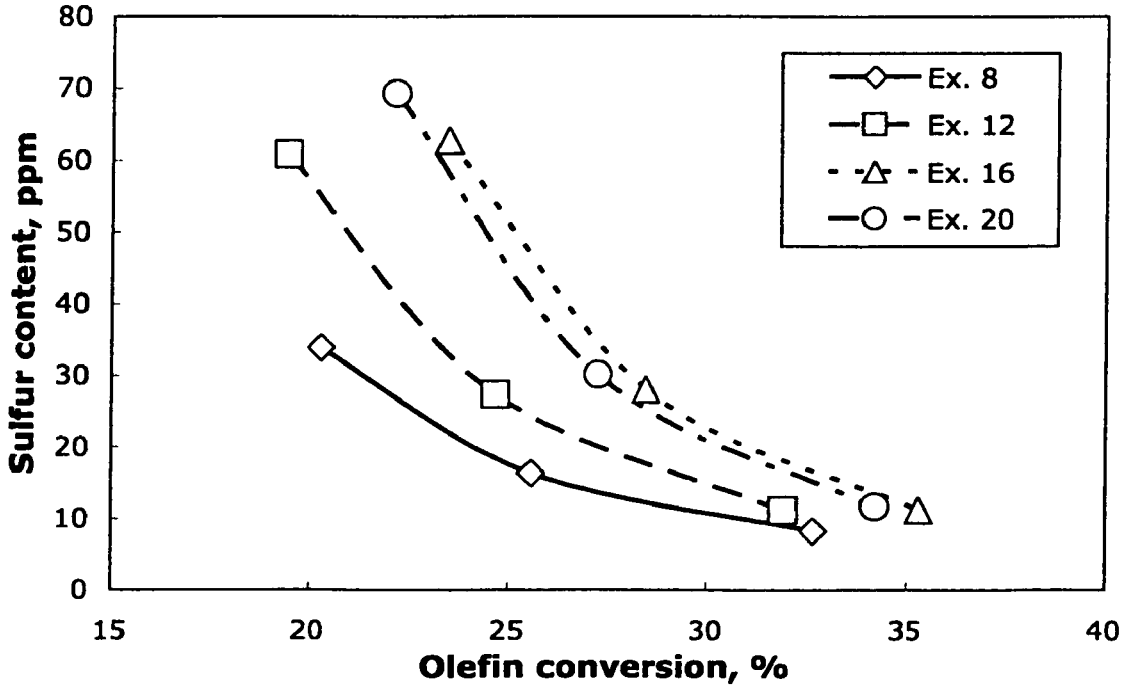
FIG. 8 attached is a graph that illustrates the effect of the catalyst nature and the presence of nitrogen in the first reaction stage on hydrodesulfurization and olefin hydrogenation in the second hydrodesulfurization stage, a less active HDS catalyst and equimolar hydrogen and nitrogen stream being employed in the second reaction stage, with $H_2S$ removal between the two stages according to Examples 8, 12, 16 and 20.

FIG. 8 is a graph illustrating the possible HDS combinations in two stages, the second stage utilizing less active catalyst and non-reactive compound added to hydrogen. Example 16, with less active catalyst and $H_2$ only in the first stage is the less selective. It can be considered that Example 8 is the more selective, utilizing the more active catalyst and pure $H_2$ in the first reaction stage.

Figure 9:
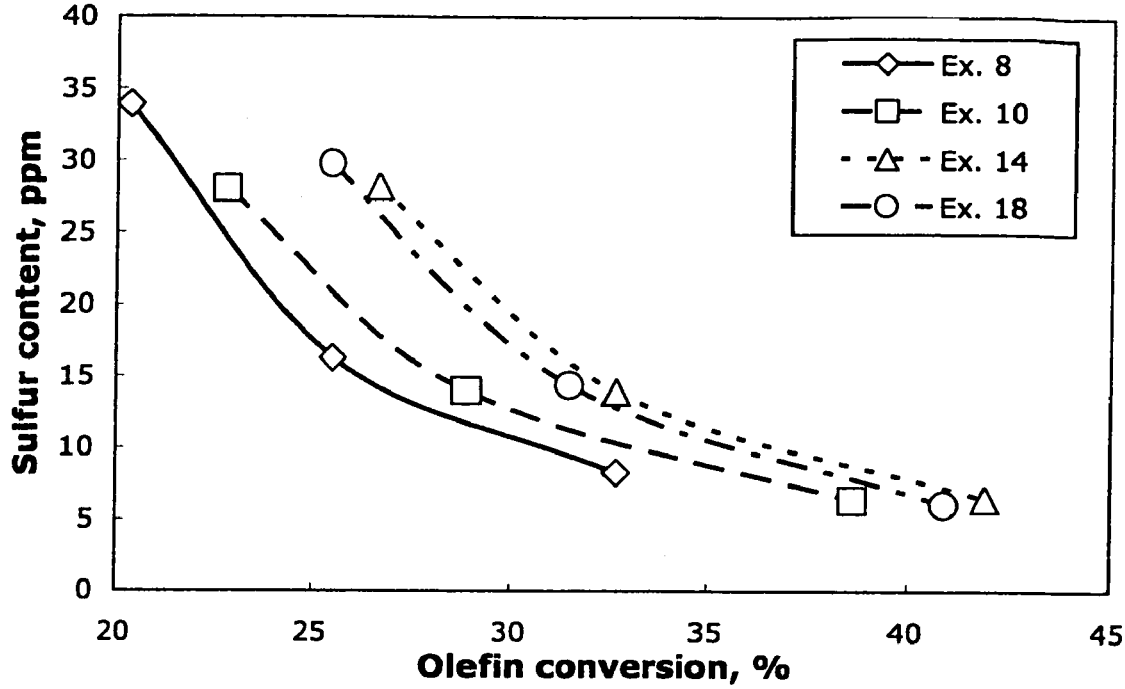
FIG. 9 attached is a graph that illustrates the effect of the catalyst nature and the presence of nitrogen in both reaction stages on the hydrodesulfurization and olefin hydrogenation, according to Examples 8, 10, 14 and 18.

From FIGS. 1 to 4 it was possible to assess the more selective Examples among each group of Examples, those being Examples 8, 10, 14 and 18. FIG. 9 shows the comparison of the cited Examples. It can be seen that Example 14, less active catalyst in an $H_2$+$N_2$ atmosphere in the first stage and more active catalyst with $H_2$ in the final stage is the less selective. The highest selectivity condition is that of Example 8, where the more active catalyst and pure $H_2$ atmosphere are utilized in the first stage, and less active catalyst and at least one non-reactive compound is added to the second reaction stage.

Figure 10:
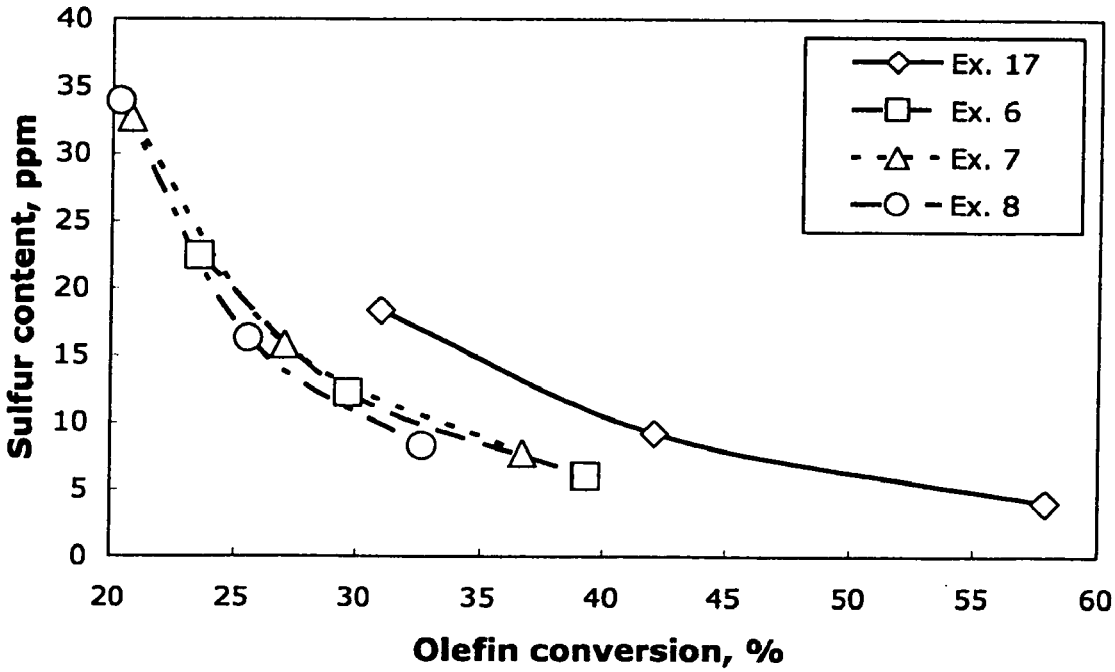
FIG. 10 attached is a graph that illustrates the effect of the catalyst nature and the presence of nitrogen in both reaction stages, on the hydrodesulfurization and olefin hydrogenation, according to Examples 17, 6, 7 and 8.

From FIGS. 5 to 8 were assessed the more selective Examples of each group of Examples, those being Examples 17, 6, 7 and 8. In FIG. 10 are compared the cited Examples. It can be seen that Example 17, less active catalyst in an $H_2$+$N_2$ atmosphere in the first stage followed by more active catalyst under pure $H_2$ atmosphere in the final stage is the less selective. Examples 6 and 7 are of similar selectivity, both utilizing pure $H_2$ and more active catalyst in the first stage. The difference of Examples 6 and 7 lies in the utilization of more active catalyst with added non-reactive compound in the final stage or less active catalyst with pure hydrogen in the final stage. The highest selectivity condition is, however, again that of Example 8, where the more active catalyst and pure $H_2$ atmosphere are used in the first stage and less active catalyst and at least one non-reactive compound is added to the second reaction stage.

Based on the comparisons and on all the possible combinations of the use of two catalysts of distinct activities and the addition or not of a non-reactive compound, it can be observed that Example 8 is the more selective one.

Figure 11:
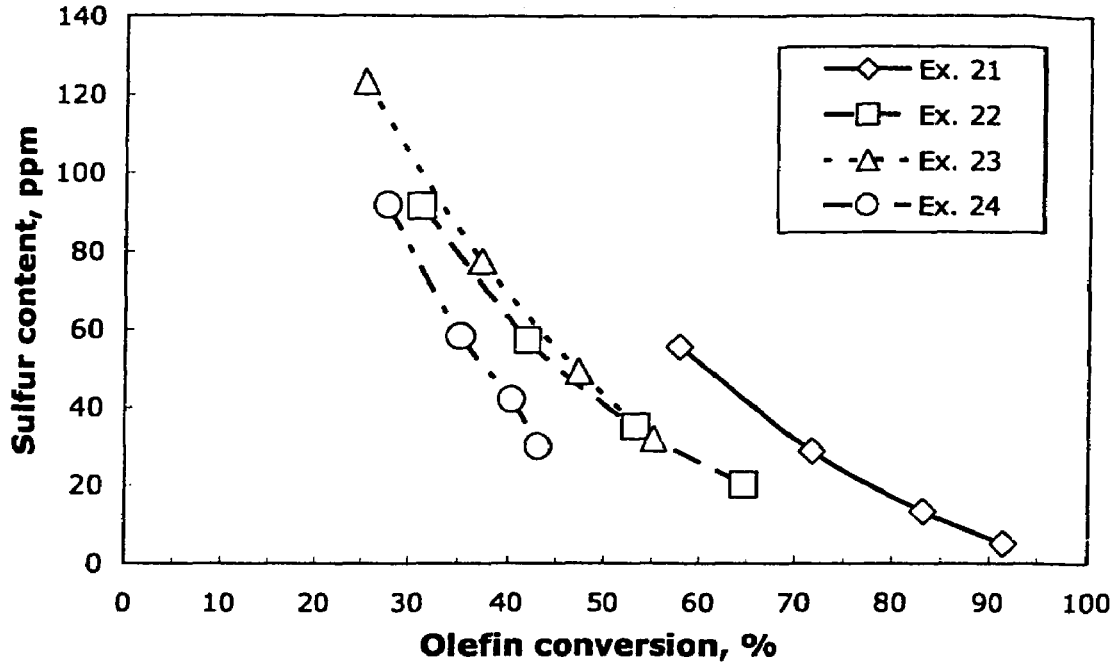
FIG. 11 attached is a graph that illustrates, for the sake of comparison, the one-stage hydrodesulfurization state-of-the-art, with and without the addition of a non-reactive compound, in a more active and less active HDS catalyst, according to Examples 21, 22, 23 and 24.

In Examples 20 to 24, illustrated in FIG. 11, is presented the state-of-the-art of hydrodesulfurization in one reaction stage. The conditions aimed at reaching low sulfur contents of the same order as those reached in the present invention (lower than 30 ppm, preferably 10 ppm sulfur). Data show for the more active catalyst that, by comparison with HDS in an $H_2$ atmosphere, (Example 21), the addition of at least one non-reactive compound (Example 22) results into higher selectivity. The selectivity of the less active catalyst in a $H_2$ atmosphere (Example 23) is similar to that of the more active catalyst and added non-reactive compound. The addition of non-reactive compound to the test with less active catalyst (Example 24) resulted in additional selectivity gains. However, present invention data with inert (non-reactive) added compound and distinct catalysts bear significantly higher selectivity. Still, in the state-of-the-art one-stage process it was difficult to obtain low sulfur levels (lower than 30 ppm) without high olefin hydrogenation.

As is well known from the state-of-the-art technique, the MgO and $Al_2O_3$ mixed oxide similar to that employed in the present invention, of lower activity when compared to the higher activity catalyst, is more selective for the naphtha HDS. Such higher selectivity is evidenced by comparing Examples 21 and 23. The less active catalyst keeps on being more selective in the HDS with at least one non-reactive compound to the process, according to Examples 22 and 24.

Figure 12:
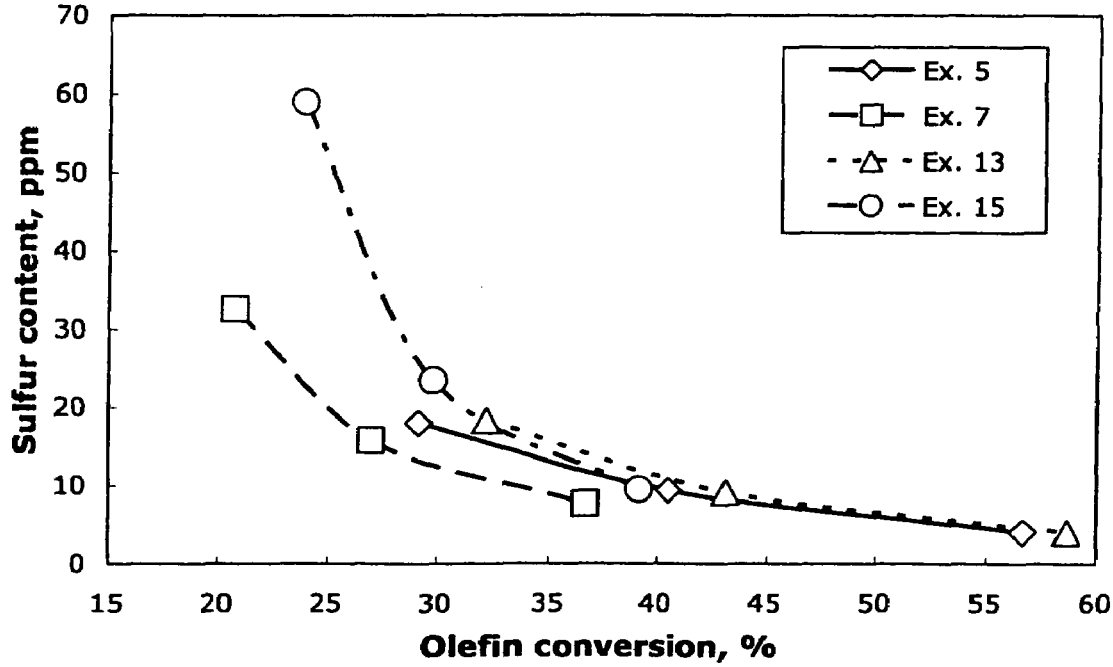
FIG. 12 attached is a graph that illustrates, for the sake of comparison, the two-stage hydrodesulfurization state-of-the-art, without the addition of a non-reactive compound, in a more and/or less active HDS catalyst, according to Examples 5, 7, 13 and 15.

It is expected that the higher selectivity of the less active catalyst is kept in both reaction stages. The possible setup combinations of the two distinct catalysts in hydrogen atmosphere HDS are those illustrated in FIG. 12.

Figure 13:
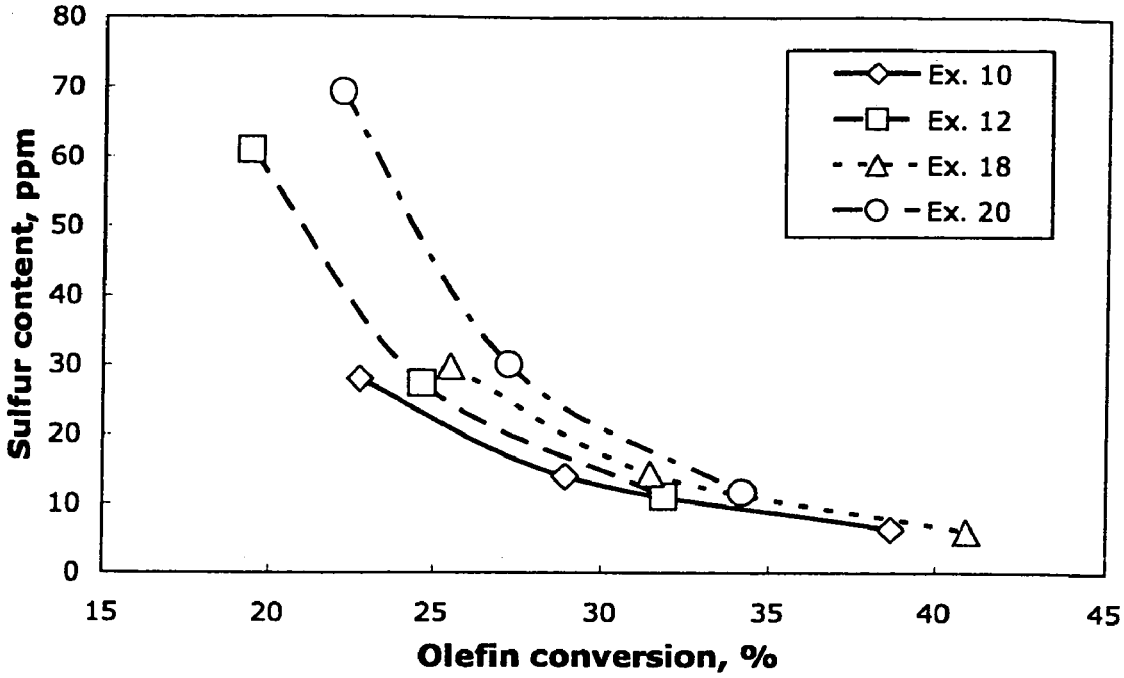
FIG. 13 attached is a graph that illustrates, for the sake of comparison, the two-stage hydrodesulfurization state-of-the-art, with the addition of a non-reactive compound in both stages, in a more and/or less active HDS catalyst, according to Examples 10, 12, 18 and 20.

In this case, it is not valid that the combination of less active catalyst in both reaction stages results in higher selectivity, which is obtained by the use of the higher activity catalyst followed by the lower activity catalyst. On the other hand, it could be stated that this unexpected behavior would be also valid in the presence of non-reactive compound added to both stages. FIG. 13 illustrates the comparison of Examples 10, 12, 18 and 20, in which the non-reactive compound is added to both stages. In these cases, HDS performed with more active catalyst in both stages has revealed itself more selective. Such unexpected results show that the combination of the addition of non-reactive compounds in two reaction stages and distinct catalysts in both stages is not trivial and cannot be envisaged as a mere combination of state-of-the-art techniques.

Figure 14:
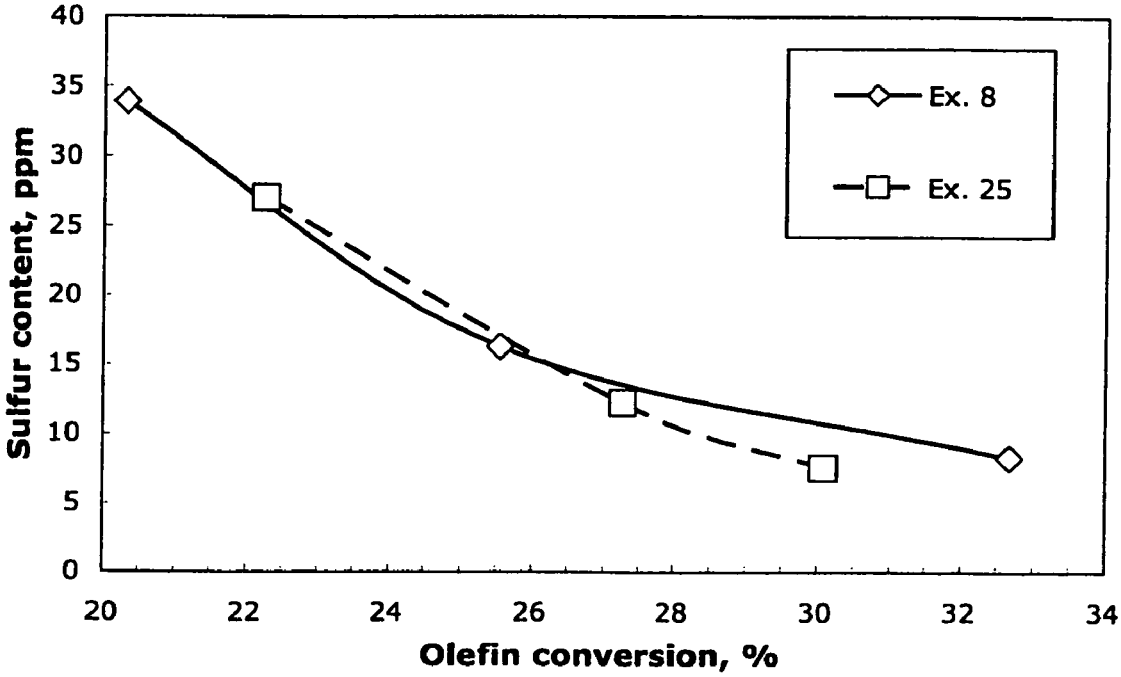
FIG. 14 attached is a graph that illustrates as related to the present invention, the two-stage hydrodesulfurization process with addition of non-reactive compound to both reaction stages, and a more active HDS catalyst in the first stage, where the $H_2$ concentration is higher in the first than in the second stage, and a further mode of the present invention where $H_2$ only is used in the first reaction stage, according to Examples 25 and 8.

Example 25 illustrates one of the preferred configurations of the present invention, with the more active catalyst in the first stage, non-reactive compound added to both reaction stages and higher $H_2/(H_2$+non-reactive compound) ratio in the first stage. The first stage product of Example 25 can be considered as equivalent to those of Examples 1 to 4. FIG. 14 illustrates the comparison of the selectivity obtained in Example 25 with that obtained in Example 8, which represents another preferred mode of the present invention (without added non-reactive compounds in the first stage). The comparison shows that in Example 25 the same or better selectivity was obtained at low sulfur contents (10 ppm and less) relative to Example 8. Through the addition of non-reactive compounds in both reaction stages, and $H_2$ concentration higher in the first reaction stage than in the second stage, it is possible to obtain the same or better results than by using $H_2$ only in the initial reaction stage, in both cases utilizing in the final stage a less active catalyst and at least one added non-reactive compound.

Comparative Examples, including the state-of-the-art in two or in one stage, without the addition of non-reactive compound, and employing just one kind of catalyst in distinct reaction stages show the improved selectivity attained through the process of the invention. The advantages provided by the invention result from a more active catalyst in the first reaction stage up to an average hydrodesulfurization level, removing the $H_2S$ generated in the reaction, and feeding the first stage product to a second hydrodesulfurization stage using less active catalyst and at least one added non-reactive compound such as $N_2$.

Without wishing to limit in any extent the scope of the present invention to a hypothesis of the effect of $N_2$ and catalyst in each reaction step on the selectivity, it is believed that for the same sulfur content, in the first hydrodesulfurization stage with hydrogen only (or utilizing more active catalyst), the sulfur nature is more mercaptidic. The more active HDS catalyst leads to a higher conversion of the sulfur species from thiophenic to mercaptidic, even without high overall sulfur conversion. One of the HDS routes of the thiophenic species can involve ring hydrogenation, which at higher hydrogen concentration and more active catalyst occurs to a higher extent.

In the first HDS stage, with hydrogen only (or utilizing more active catalyst) lower temperature is required, the mercaptidic sulfur content is higher and the thiophenic sulfur content is lower, since the thiophenic compound conversion depends on the partial hydrogen pressure and the recombination is favored at low temperatures. For the same HDS level, at lower $H_2/(H_2+N_2)$ mole ratio in the hydrogen stream and non-reactive compounds, the required temperature is higher, the $H_2S$ recombination is lower, but the more refractory thiophenic sulfur content is higher.

The more active HDS catalyst requires lower reaction temperature for the same sulfur removal level and thus, higher mercaptidic compound content. Sulfur speciation analytical tests of first stage products generated in Examples 1 to 4 agree with lower mercaptidic sulfur contents in the hydrotreatment with the hydrogen and non-reactive compounds stream and higher mercaptidic sulfur contents in the HDS performed with hydrogen stream only.

Thus, the combination of more active catalyst and lower concentration of non-reactive compound (or non-addition of non-reactive compound) in a first reaction stage allows that, sulfur conversion levels to more desulfurizable species is attained a posteriori when $H_2S$ reaction product is removed.

In the second stage, the mercaptidic species are more easily hydrodesulfurized than the thiophenic ones, since $H_2S$, the compound that directs the recombination is removed. And, with the hydrogen and at least one added non-reactive compound stream, it is possible to promote the same HDS final level, at lower olefin hydrogenation. The combination of less active catalyst and non-reactive compound unexpectedly permits that selectivity levels unknown in the state-of-the-art technique be attained, those levels being unknown even for previous processes of the same Applicant.

Even the less active catalyst such as that based on MgO and alumina mixed oxide being known as more selective for the one-stage reaction tests, the mercaptidic compound content of the sulfur resulting from the catalyst is lower. And, for the same sulfur content, those are more refractory in a final reaction stage. Thus, unexpectedly, even with a more selective catalyst in both stages, and for any combination, it was not possible to obtain better results than those of the preferred mode and claim of the present invention, that is, the use of more active HDS catalyst in the first stage and less active HDS catalyst in the final stage, with the addition of at least one non-reactive compound in the final reaction stage.

Thus, without wishing to limit the scope of the invention, it is believed that for same sulfur content, in the first hydrotreatment stage containing more active catalyst and hydrogen only, in spite of the lower selectivity, the sulfur nature is more mercaptidic. One of the HDS routes of the thiophenic species can involve ring hydrogenation which, with more hydrogen available, and more active catalyst, can occur to a higher extent. Still, the more active catalyst, by definition, is the one which performs the same HDS than a less active catalyst, at a lower temperature. Lower temperature in the first stage where the $H_2S$ concentration is significant as well as the recombination reaction lead to higher mercaptidic sulfur content in the product.

For fixed LHSV, pressure and gas/feed ratio values, it can be stated that for same HDS level, with a more active catalyst and just $H_2$, or lower levels of addition of non-reactive compounds, it is possible to operate at lower temperature, sulfur recombination is more favored, and the thiophenic sulfur is lower, since the conversion of thiophenic compounds depends on hydrogen partial pressure. For the same HDS level, employing a mixture of $H_2$ and at least one added non-reactive compound, the temperature is higher, the sulfur recombination is lower, and olefins are less hydrogenated, but the content of more refractory thiophenic sulfur is higher.

Sulfur speciation analyses obtained from Examples 2 and 4 (first stage products) agree with lower mercaptidic sulfur contents in the hydrotreatment with an atmosphere containing at least one added non-reactive compound.

In the second stage, mercaptidic species are more easily converted than thiophenic ones. Still, with a non-reactive compound admixed to hydrogen, it is possible to promote the same level of final HDS, at lower olefin hydrogenation. Therefore, it would be relevant to obtain more easily desulfurizable compounds for the second HDS stage.

In the first treatment stage on more active HDS catalyst it is possible to obtain sulfur contents lower than 300 ppm, preferably lower than 200 ppm at low olefin hydrogenation degree (<20%), with most of the sulfur compounds being mercaptans. Preferably the atmosphere of the first stage is pure hydrogen or the hydrogen mole fraction is higher than that of the second reaction stage.

The present invention, for the two-stage hydrodesulfurization of cracked naphtha streams with higher activity HDS catalyst in the first stage and lower activity HDS catalyst in the second stage, with intermediate $H_2S$ removal and final treatment under hydrogen atmosphere and non-reactive compound, permits the attainment of selectivity levels unknown in state-of-the-art processes.

It is therefore demonstrated that according to the present invention, after a first HDS stage and intermediate $H_2S$ separation, the use of non-reactive compound in the at least second HDS treatment stage and less active HDS catalyst than that of the first stage implies in better reaction selectivity.

We claim:

1. A process for the selective hydrodesulfurization of naphtha streams containing olefins and organosulfur compounds, said process including:

a) contacting said naphtha feed containing olefin content in the range of 20 to 50 mass % and sulfur in the range of 200 to 7,000 mg/kg in a first reaction stage, under hydrodesulfurization conditions comprising temperature from 200 to 420° C., pressure from 0.5 to 5.0 MPag, and space velocity LHSV between 1 to 20 $h^{-1}$, in a reactor charged with a sulfided hydrorefining catalyst, with a stream of hydrogen and at least one added non-reactive compound and limiting $H_2S$ at the reactor inlet to not more than 0.1% by volume, in order to yield an effluent;

b) removing $H_2S$ from the first reaction stage effluent so as to obtain a partially hydrodesulfurized naphtha; and c) directing said naphtha obtained in step b) towards a second reaction stage, in a reactor charged with a hydrorefining sulfided catalyst, under hydrodesulfurization conditions similar to those of the first stage, and contacting said partially hydrodesulfurized naphtha with a stream which is a mixture of $H_2$ and at least one added non-reactive compound, and limiting $H_2S$ at the reactor inlet to not more than 0.05% by volume, wherein said process comprises:

(i) in the said first reaction stage: the said hydrorefining catalyst is made up of a more active catalyst for HDS while the $H_2$ fraction in the mixture of $H_2$ and at least one added non-reactive compound is higher than the said $H_2$ fraction added to the said second reaction stage;

(ii) in the said second reaction stage: the said hydrorefining catalyst is made up of a less active catalyst for HDS, said second stage catalyst being distinct from the said first stage catalyst, and the $H_2$ fraction in the mixture of $H_2$ and at least one added non-reactive compound is lower than said $H_2$ fraction present in the said first reaction stage, and wherein (iii) the said first reaction stage catalyst is more active towards HDS than the said second reaction stage catalyst since said first reaction stage catalyst requires, for obtaining the same sulfur conversion and same hydrorefining conditions, lower temperature than the said second reaction stage catalyst for obtaining the same sulfur content when processing the same naphtha feed, whereby a hydrodesulfurized naphtha of improved selectivity relative to the state-of-the-art technique is recovered at the end of the said process, wherein the mole ratio, $H_2/(H_2$+non-reactive compound), is between 0.2 and 1.0 for the first reaction stage, and between 0.2 and 0.7 for the second reaction stage.

2. A process according to claim 1, wherein the said catalysts of the first and second reaction stages comprise metal oxides of Group VIB and Group VIII on a porous support.

3. A process according to claim 1 or 2, wherein the said catalysts of the said first and second reaction stages comprise cobalt and molybdenum with metal oxide contents from 0.5 to 30 mass %.

4. A process according to claim 1, wherein the amount of metals in the said more active catalyst for HDS of the first reaction stage is higher than that of the said less active catalyst for HDS of the second reaction stage.

5. A process according to claim 1, wherein the said first and second reaction stage catalysts are of similar composition, the said more active catalyst for HDS of the first reaction stage being a fresh catalyst while the said less active catalyst for HDS of the second reaction stage is a previously deactivated catalyst or a spent catalyst.

6. A process according to claim 1, wherein the support of the said more active catalyst for HDS of the first reaction stage is more acidic than the support of the said less active catalyst for HDS of the second reaction stage.

7. A process according to claim 1, wherein the support of the said more active catalyst for HDS of the first reaction stage comprises gamma-alumina, silica, silica-alumina, zeolites, titania, carbon, aluminum phosphate, zinc oxide, several aluminates and diatomaceous earth.

8. A process according to claim 1, wherein the intrinsic acidity of the support of the said less active catalyst for HDS of the second reaction stage is reduced by deposition of alkaline Group I metals and/or Group II alkaline-earth metals of the Periodic Table at oxide contents from 0.05 to 20 mass %.

9. A process according to claim 1, wherein the intrinsic acidity of the support of the said less active catalyst for HDS of the second reaction stage is reduced by employing a combination of 10 to 90 mass % MgO, CaO, BeO, BaO, SrO, $La_2O_3$, $CeO_2$, $Pr_2O_3$, $Nd_2O_3$, $SmO_2$, $K_2O$, $Cs_2O$, $Rb_2O$, $ZrO_2$ basic oxides and alumina as balance.

10. A process according to claim 9, wherein the intrinsic acidity of the support of the said less active catalyst for HDS of the second reaction stage is reduced by employing $Al_2O_3$ and 10 to 90 mass % MgO mixed oxides.

11. A process according to claim 1, wherein the support of the said less active catalyst for HDS of the second reaction stage comprises ó- or θ-alumina transition alumina phases, obtained by heating alumina hydrates.

12. A process according to claim 1, wherein more than one catalyst is used in each reaction stage, with the proviso that the activity for HDS resulting from the mixture or sequence of catalysts in the first reaction stage is higher than that in the second reaction stage.

13. A process according to claim 1, wherein the said added non-reactive compounds are selected among nitrogen, noble gases, saturated C1 to C4 hydrocarbons, pure or admixed in any amounts.

14. A process according to claim 13, wherein the added non-reactive compound is nitrogen.

15. A process according to claim 1, wherein in the said first reaction stage the $H_2$ mole fraction in the mixture of $H_2$ and at least one added non-reactive compound is 1.0 while in the second reaction stage said mole fraction is from 0.3 to 0.6.

16. A process according to claim 1, wherein in the said first reaction stage the $H_2$ mole fraction in the mixture of $H_2$ and at least one added non-reactive compound is 0.75 while in the said second reaction stage said mole fraction is 0.25.

17. A process according to claim 1, wherein each of said reaction stages comprises one bed or reactor upstream and/or downstream of the generated $H_2S$ removal step.

18. A process according to claim 1, wherein each of said reaction stages comprises a set of beds or a set of reactors upstream and/or downstream of the generated $H_2S$ removal step.

* * * * *